US008706018B2

(12) United States Patent
Furuya et al.

(10) Patent No.: US 8,706,018 B2
(45) Date of Patent: Apr. 22, 2014

(54) POSITION DETECTION APPARATUS, PAPER THICKNESS DETECTION APPARATUS, BELT POSITION DETECTION APPARATUS, AND IMAGE FORMING APPARATUS

(75) Inventors: Takao Furuya, Ebina (JP); Kaoru Yoshida, Ashigarakami-gun (JP); Yoshinari Iwaki, Ebina (JP); Minoru Ohshima, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1143 days.

(21) Appl. No.: 12/268,059

(22) Filed: Nov. 10, 2008

(65) Prior Publication Data

US 2009/0257800 A1 Oct. 15, 2009

(30) Foreign Application Priority Data

Apr. 9, 2008 (JP) ..... 2008-101450

(51) Int. Cl.
*G03G 15/00* (2006.01)
*B65H 7/02* (2006.01)
*B65H 7/14* (2006.01)

(52) U.S. Cl.
USPC ..... 399/389; 271/265.04

(58) Field of Classification Search
USPC ..... 399/361, 376, 389
See application file for complete search history.

(56) References Cited

U.S. PATENT DOCUMENTS 3,896,451 A * 7/1975 Omi ..... 347/152
5,923,140 A * 7/1999 Azumi et al. ..... 318/640
6,850,717 B2 * 2/2005 Fujikura et al. ..... 399/45
7,742,736 B2 * 6/2010 Kobayashi et al. ..... 399/389
2004/0076457 A1 * 4/2004 Chung ..... 399/361
2006/0289280 A1 12/2006 Furuya et al.
2007/0147919 A1 * 6/2007 Lim ..... 399/388
2008/0056778 A1 * 3/2008 Tao et al. ..... 399/302
2009/0047097 A1 * 2/2009 Luo et al. ..... 411/426
2010/0301551 A1 * 12/2010 Muranaka et al. ..... 271/265.04

FOREIGN PATENT DOCUMENTS

JP 53131666 A * 11/1978 ..... B65H 7/12
JP 54088559 A * 7/1979 ..... B65H 7/12
JP 57190961 A * 11/1982 ..... G03G 15/00
JP 60015337 A * 1/1985 ..... B65H 7/02
JP 61197345 A * 9/1986 ..... G03G 15/00
JP 02169439 A * 6/1990 ..... G03G 15/00
JP 04198802 A * 7/1992 ..... B65H 7/12

(Continued)

OTHER PUBLICATIONS

Sep. 24, 2012 Office Action issued in Chinese Application No. 200910000437.4 (with translation).

(Continued)

*Primary Examiner* — Nguyen Ha
(74) *Attorney, Agent, or Firm* — Oliff PLC

(57) ABSTRACT

A position detection apparatus includes: a moving member in contact with a detection object that moves following movement of the detection object; and a support member that rotatably supports the moving member; a detection unit that detects a positional change of the moving member, the moving member being acted on by a first force as a force to press the moving member against the detection object, a second force as a force to press the moving member substantially in a direction of a rotation shaft of the moving member, and a third force as a force to press the moving member in a direction substantially orthogonal to the direction of the rotation shaft of the moving member.

14 Claims, 24 Drawing Sheets

(56) References Cited

FOREIGN PATENT DOCUMENTS

| | | | | | |
|---|---|---|---|---|---|
| JP | A-04-198802 | | | 7/1992 | |
| JP | 07025511 | A | * | 1/1995 | ..... B65H 7/02 |
| JP | 07206220 | A | * | 8/1995 | ..... B65H 7/10 |
| JP | 07215538 | A | * | 8/1995 | ..... B65H 7/12 |
| JP | 10153927 | A | * | 6/1998 | ..... G03G 15/16 |
| JP | A-10-310286 | | | 11/1998 | |
| JP | 2000072281 | A | * | 3/2000 | ..... B65H 7/02 |
| JP | 2000191168 | A | * | 7/2000 | ..... G03G 15/00 |
| JP | 2003294401 | A | * | 10/2003 | ..... B65H 7/14 |
| JP | 2004202747 | A | * | 7/2004 | ..... G03G 15/00 |
| JP | A-2004-202747 | | | 7/2004 | |
| JP | A-2006-343629 | | | 12/2006 | |
| JP | A-2007-297190 | | | 11/2007 | |

OTHER PUBLICATIONS

Aug. 2, 2012 Notificaion of Reasons for Refusal issued in Japanese Patent Application No. 2008-101450 (with translation).

* cited by examiner

POSITION DETECTION APPARATUS, PAPER THICKNESS DETECTION APPARATUS, BELT POSITION DETECTION APPARATUS, AND IMAGE FORMING APPARATUS

CROSS-REFERENCE TO RELATED APPLICATIONS

This application is based on and claims priority under 35 USC 119 from Japanese Patent Application No. 2008-101450 filed Apr. 9, 2008.

BACKGROUND

Technical Field

The present invention relates to a position detection apparatus, a paper thickness detection apparatus, a belt position detection apparatus, and an image forming apparatus.

SUMMARY

According to an aspect of the invention, there is provided a position detection apparatus including: a moving member in contact with a detection object that moves following movement of the detection object; a support member that rotatably supports the moving member; and a detection unit that detects a positional change of the moving member, the moving member being acted on by a first force as a force to press the moving member against the detection object, a second force as a force to press the moving member substantially in a direction of a rotation shaft of the moving member, and a third force as a force to press the moving member in a direction substantially orthogonal to the direction of the rotation shaft of the moving member.

BRIEF DESCRIPTION OF THE DRAWINGS

Exemplary embodiments of the present invention will be described in detail based on the following figures, wherein.

DETAILED DESCRIPTION

Next, an exemplary embodiment of the present invention will be described based on the drawings.

Figure 1:
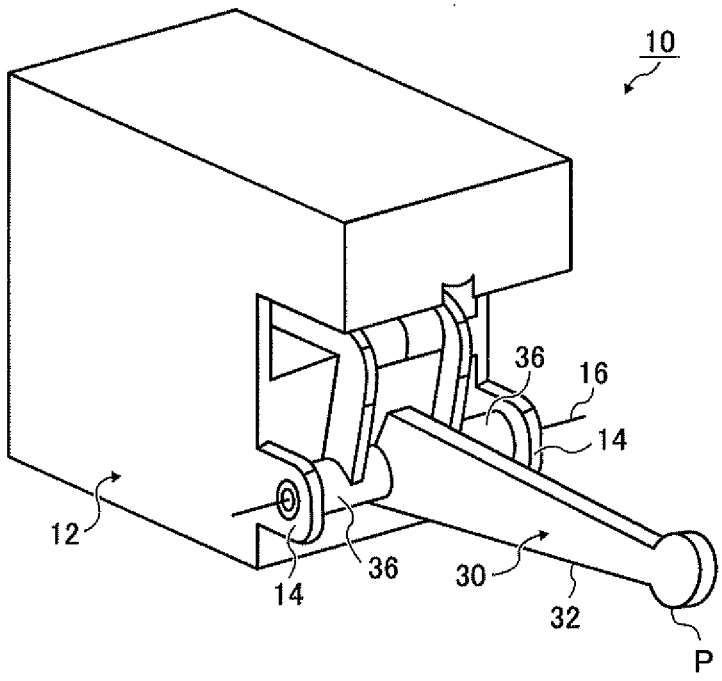
FIG. 1 is a perspective view showing a position detection apparatus according to an exemplary embodiment to which the present invention is applied.
Figure 2A:
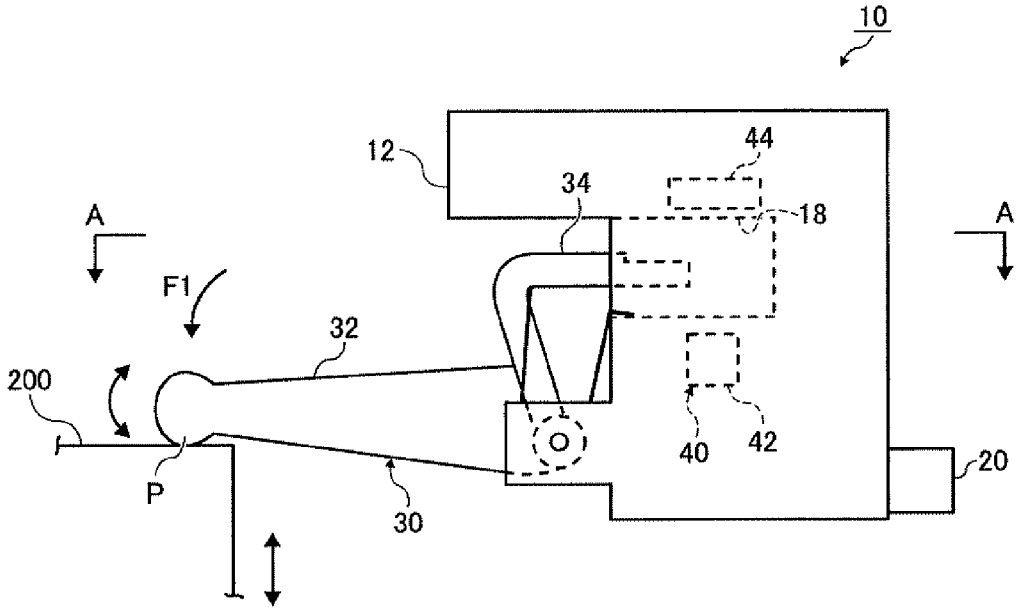
FIG. 2A is a right side view showing the position detection apparatus according to the exemplary embodiment to which the present invention is applied.
Figure 2B:
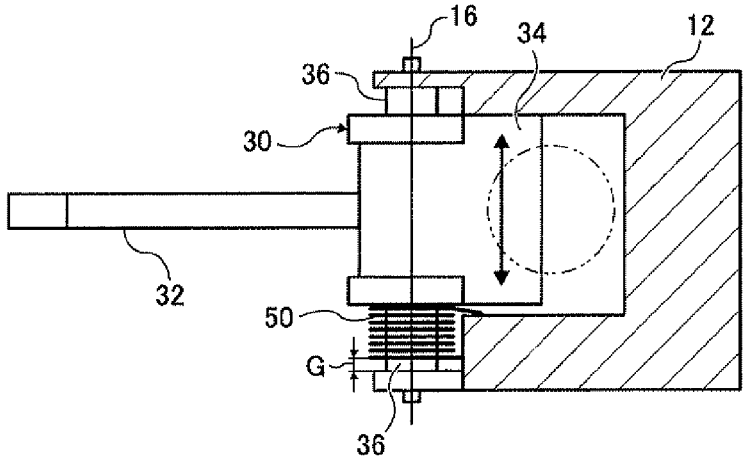
FIG. 2B is a cross-sectional view along a line A-A in FIG. 2A.

FIG. 1 and FIGS. 2A and 2B show a position detection apparatus 10 according to an exemplary embodiment to which the present invention is applied. As shown in FIG. 1 and FIGS. 2A and 2B, the position detection apparatus 10 has a position detection apparatus main body 12, a moving member 30, and a photosensor 40.

The position detection apparatus main body 12 is used as a support member to rotatably support the moving member 30. The position detection apparatus main body 12 supports the moving member 30, with side plates 14 provided on left and right sides, rotatably about a rotation shaft 16. Further, in the position detection apparatus main body 12, a concave member 18 is formed frontward, and a connector 20 used as a connecting member for connection with an external device upon output of detection data is attached.

The moving member 30, in contact with a detection object 200 as an object of position detection, moves following movement of the detection object 200. The moving member 30 has a contact plate 32 with a contact member P to be in contact with the detection object 200 and a detected plate 34 used as a member detected by the photosensor 40, and has a shape such that the contact plate 32 and the detected plate 34 are connected with shafts 36. At least a part of the detected plate 34 is inserted in the concave member 18.

Further, the moving member 30, to which a spring 50 having a torsion spring is attached, is pressed with the torsion spring 50, and is acted on by a first force F1 as a force in a direction to press the moving member 30 against the detection object 200. The force F1 rotates the moving member 30 about the rotation shaft 16 in a direction indicated with an arrow in FIG. 2A.

The photosensor 40 has a light emitting unit 42 to emit light and a light receiving unit 44 to receive light emitted from the light emitting unit 42. The light emitting unit 42 is attached in a face-up status to a lower surface of the concave member 18 formed in the position detection apparatus main body 12. The light receiving unit 44 is attached, facing the light emitting unit 42, to an upper surface of the concave member 18. In FIG. 2B, a circle indicated with an alternate long and two short dashes line represents a range of arrival of light emitted from the light emitting unit 42.

In the position detection apparatus 10 according to the exemplary embodiment to which the present invention is applied, having the above configuration, some of light emitted from the light emitting unit 42 is blocked with the detected plate 34, and at least a part of unblocked light is received by the light receiving unit 44. Then, the connector 20 outputs an output voltage in correspondence with the amount of light received by the light receiving unit 44. At this time, when the detection object 200 moves upward/downward, the moving member 30 rotate-moves about the rotation shaft 16 following the movement of the detection object 200. The rotation-movement of the moving member 30 changes the amount of light blocked with the detected plate 34, and changes the amount of light which arrives at the light receiving unit 44, thus changes the output voltage outputted from the connector 20. Then, in the position detection apparatus 10, the position of the detection object 200 is detected from the output voltage, and the movement of the detection object 200 is detected from the change of output voltage.

Further, in the position detection apparatus 10 to which the present invention is applied, having the above structure, in detection of the position and movement of the detection object 200, as shown in FIG. 2B, for example, when a play G exists in the direction of the rotation shaft 16 or a play exists in a direction in which the rotation shaft 16 is inclined in accordance with precision of build-up of the moving member 30 in the position detection apparatus main body 12, even when the detection object 200 remains in the same position, the relative position of the moving member 30 to the position detection apparatus main body 12 and the photosensor 40 is not fixed. The amount of light received by the light receiving unit 44 is not fixed, and the output voltage from the connector 20 varies, thus a detection error may occur.

Figure 3:
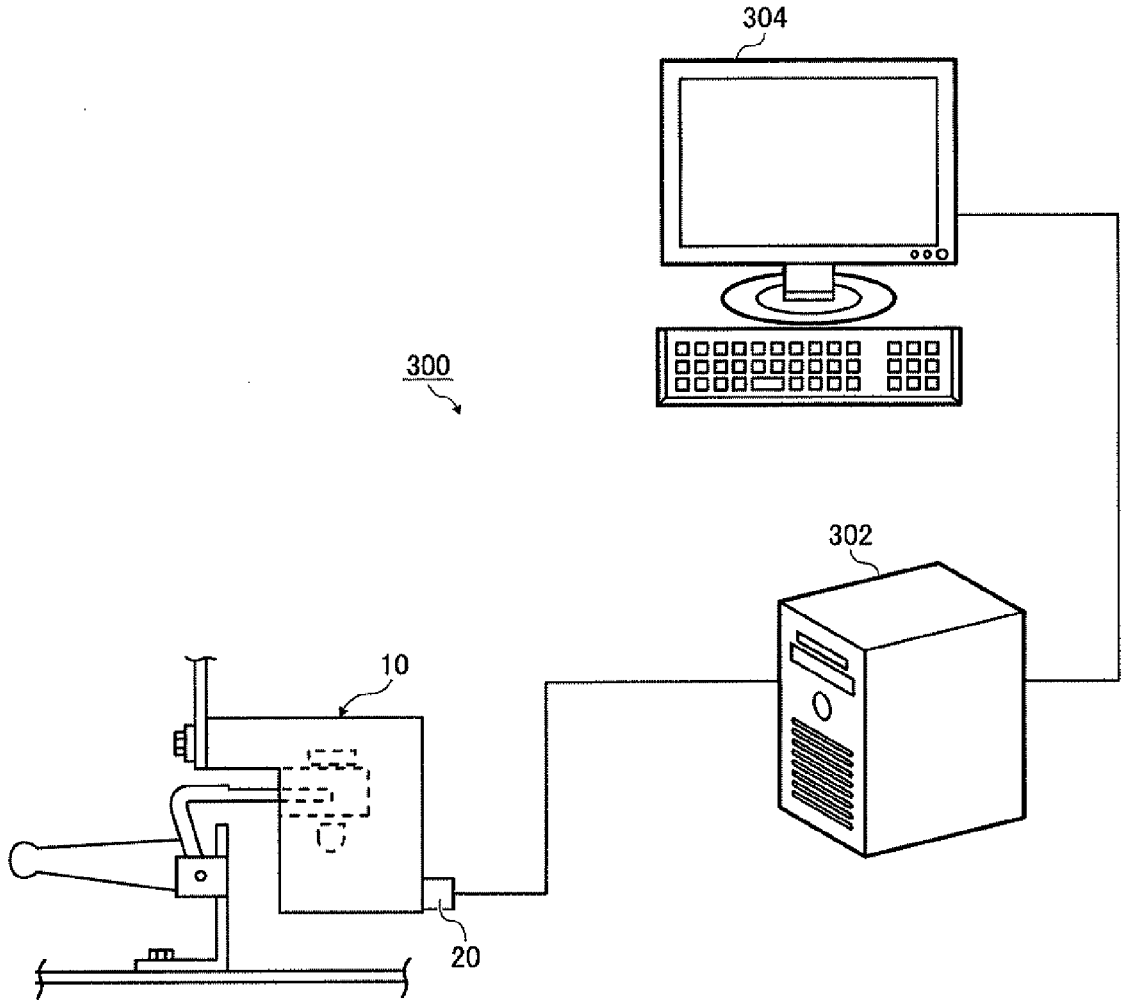
FIG. 3 is an explanatory view showing a position detection system using the position detection apparatus according to a first exemplary embodiment of the present invention.

FIG. 3 shows a position detection system 300 using the position detection apparatus 10 according to a first exemplary embodiment of the present invention.

The position detection system 300 has the position detection apparatus 10, a data processing device 302 and a display 304. The data processing device 302 processes detection data outputted from the connector 20, and the display 304 displays the detection result.

Figure 4A:
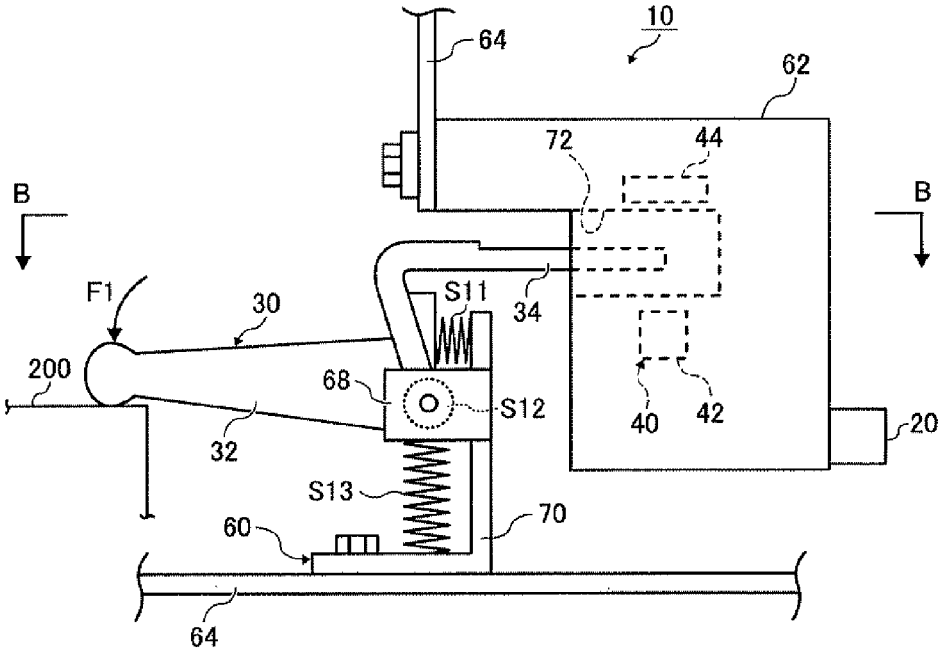
FIG. 4A is a right side view showing the position detection apparatus according to the first exemplary embodiment of the present invention.
Figure 4B:
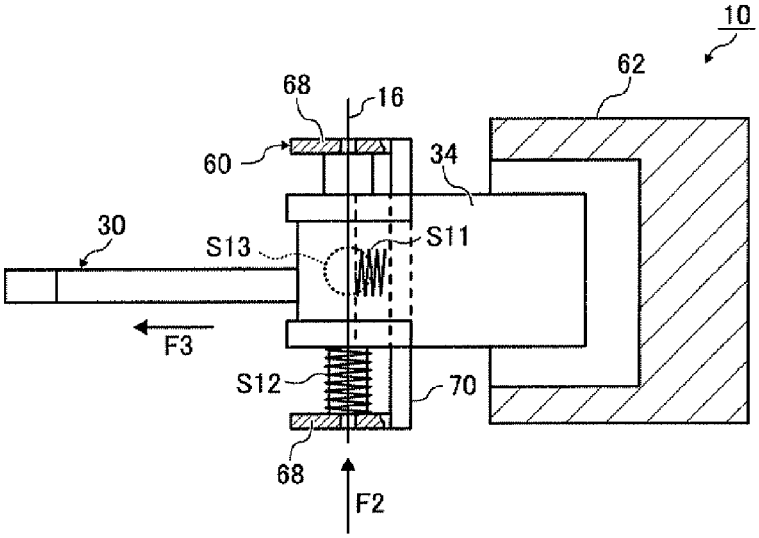
FIG. 4B is a cross-sectional view along a line B-B in FIG. 4A.

FIGS. 4A and 4B show the position detection apparatus 10 according to the first exemplary embodiment of the present invention.

In the above-described exemplary embodiment to which the present invention is applied, the moving member 30 is supported with the position detection apparatus main body 12, and the photosensor 40 is attached in the position detection apparatus main body 12. In the position detection apparatus 10 according to the first exemplary embodiment of the present invention, the moving member 30 is supported with a support member 60, and the photosensor 40 is attached in a housing 62 as other member than the support member 60.

The support member 60 is used as a support member to rotatably support the moving member 30. The support member 60, attached to a main body frame 64, has side plates 68 to support the moving member 30, and a vertical plate 70 as an approximately vertical member to the main body frame 64. The housing 62 is supported with the main body frame 64, the connector 20 is attached to the housing 62, and a concave member 72 is formed in the housing 62. At least a part of the detected plate 34 of the moving member 30 is inserted in the concave member 72.

Further, the position detection apparatus 10 according to the above-described exemplary embodiment to which the present invention is applied has the torsion spring 50. The position detection apparatus 10 according to the first exemplary embodiment of the present invention has a first spring S11, a second spring S12 and a third spring S13.

The first spring S11 is used as a first pressing member to press the moving member 30 so as to cause the force F1 as a force in the direction to press the moving member 30 against the detection object 200 to act on the moving member 30. One end side of the first spring S11 is attached to the vertical plate 70, and the other end side is in contact with the moving member 30. Accordingly, the moving member 30 is pressed in the direction to be pressed against the detection object 200 such that the moving member 30 rotates about the rotation shaft 16. As the first spring S11, a coil spring as shown in FIGS. 4A and 4B is used.

The second spring S12 is used as a second pressing member to press the moving member 30 so as to cause a second force F2 as a force to press the moving member 30 substantially in the direction of the rotation shaft 16 to act on the moving member 30. One end side of the second spring S12 is attached to the right side plate 68, and the other end side is in contact with the moving member 30. Accordingly, the moving member 30 is pressed from the right side to the left side, and the pressed with the left side plate 68 in the direction of the rotation shaft 16. As the second spring S12, a coil spring as shown in FIGS. 4A and 4B is used.

The third spring S13 is used as a third pressing member to press the moving member 30 so as to cause a third force F3 to press the moving member 30 in a direction substantially orthogonal to the direction of the rotation shaft 16 to act on the moving member 30. The lower side of the third spring S13 is attached to e.g. the support member 60, and the upper end side is in contact with the moving member 30. Accordingly, in FIG. 4A, the moving member 30 is pressed from the lower side to the upper side, and is pressed with the left and right side plates 68 of the support member 60. As the third spring S13, a coil spring as shown in FIGS. 4A and 4B is used.

As described above, the moving member 30 is acted on by the first force F1, the second force F2 and the third force F3. That is, as in the case of the above-described exemplary embodiment to which the present invention is applied, the moving member 30 is acted on by, in addition to the force F1 to press the moving member 30 against the detection object 200, the force F2 to press the moving member 30 substantially in the direction of the rotation shaft 16 to the support member 60, and the force F3 to press the moving member 30 in the direction substantially orthogonal to the rotation shaft 16 to the support member 60.

Figure 5A:
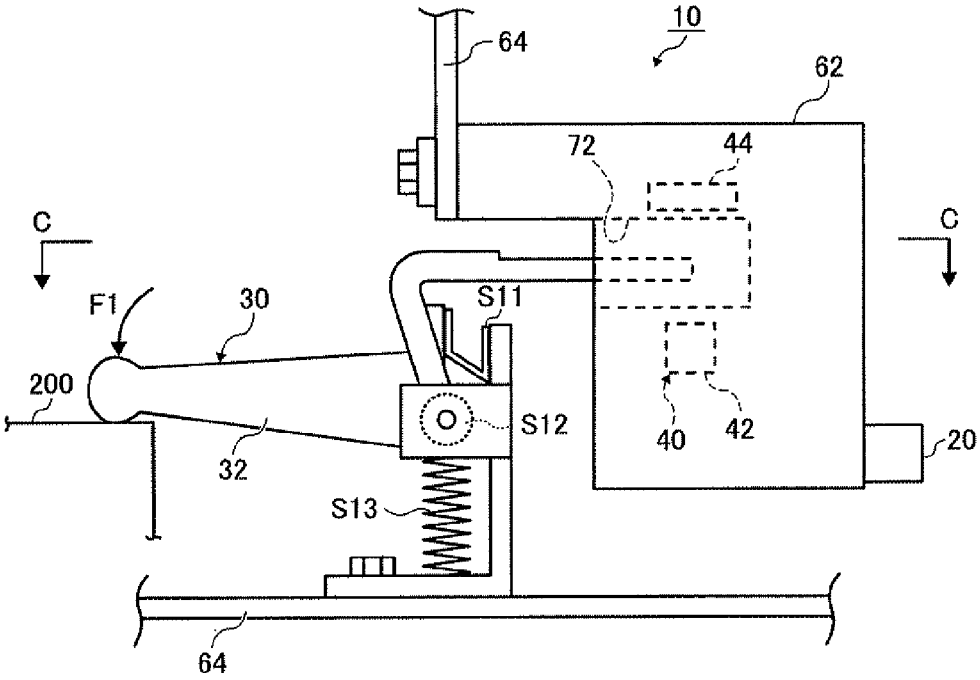
FIG. 5A is a right side view showing the position detection apparatus according to a first modification of the first exemplary embodiment of the present invention.
Figure 5B:
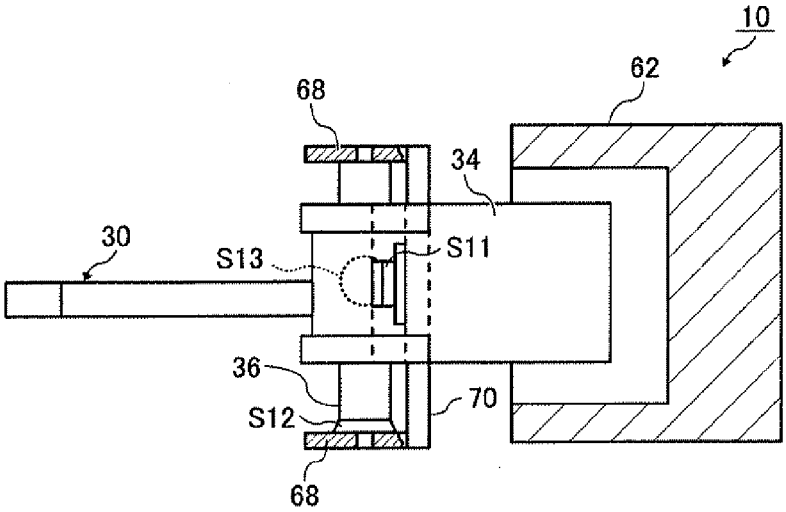
FIG. 5B is a cross-sectional view along a line C-C in FIG. 5A.

FIGS. 5A and 5B show the position detection apparatus 10 according to a first modification of the first exemplary embodiment of the present invention.

In the position detection apparatus 10 according to the above-described first exemplary embodiment, coil springs are used as the first spring S11 and the second spring S12. In the position detection apparatus 10 according to the first modification of the first exemplary embodiment of the present invention, as shown in FIGS. 5A and 5B, as the first spring S11 and the second spring S12, plate springs are used. The first spring S11 is a plate of elastic body such as metal which is folded in two positions. The first spring S11 has a shape having mutually approximately parallel portions. One of the mutually approximately parallel portions is attached to the vertical plate 70, and the other one of the mutually approximately parallel portions is in contact with the moving member 30. The second spring S12 is a plate of elastic body such as metal having a curved shape. The second spring S12 is attached to the right side plate 68, and in contact with a right shaft 36 of the moving member 30.

Figure 6A:
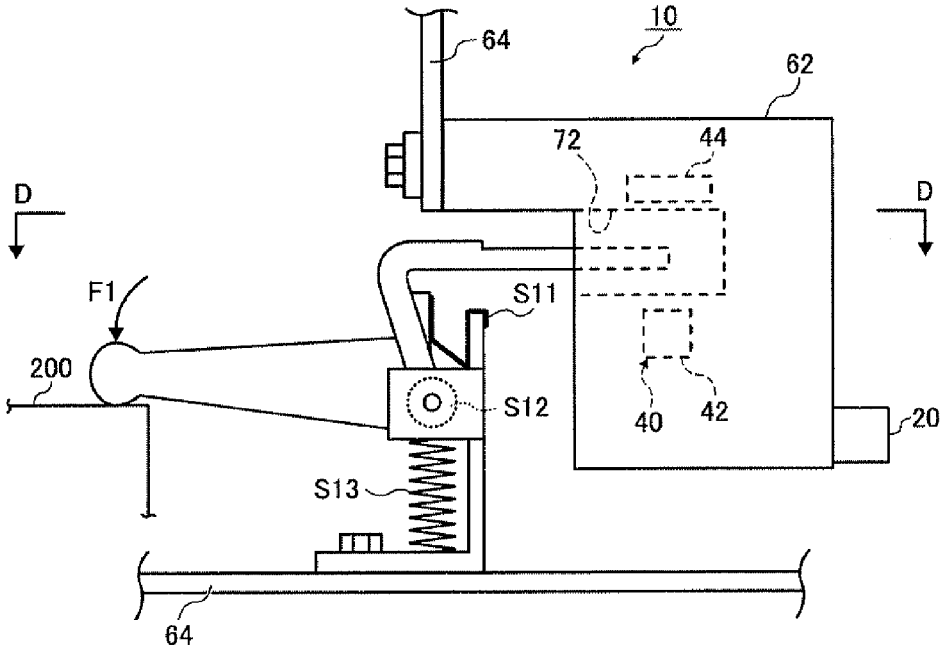
FIG. 6A is a right side view showing the position detection apparatus according to a second modification of the first exemplary embodiment of the present invention.
Figure 6B:
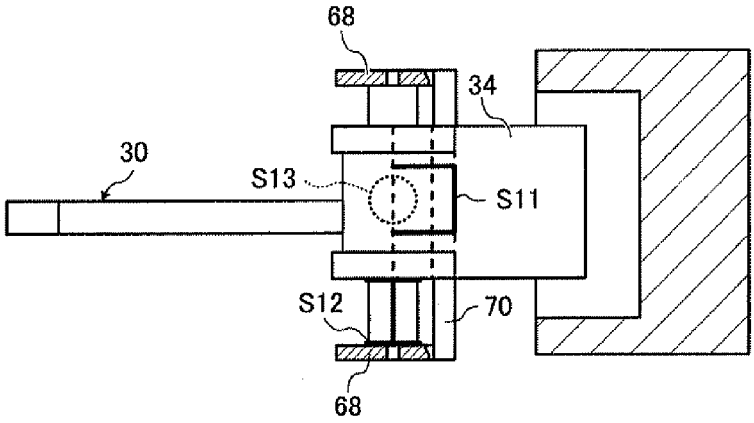
FIG. 6B is a cross-sectional view along a line D-D in FIG. 6A.

FIGS. 6A and 6B show the position detection apparatus 10 according to a second modification of the first exemplary embodiment of the present invention.

In the position detection apparatus 10 according to the above-described first exemplary embodiment, coil springs are used as the first spring S11 and the second spring S12. In the position detection apparatus 10 according to the second modification of the first exemplary embodiment of the present invention, as shown in FIGS. 6A and 6B, wire springs are used as the first spring S11 and the second spring S12. The wire spring is a spring formed by bending a wire of elastic body such as metal. As the first spring S11, a thin metal wire is bend-processed such that it is attached to be fitted in the vertical plate 70 of the support member 60 and a portion projected to the moving member 30 side presses the moving member 30. As the spring S12, a thin metal wire is bend-processed so as to have a portion in contact with the right side plate 68 of the support member 60, a portion in contact with the moving member 30, and a portion connecting the both portions.

Figure 7A:
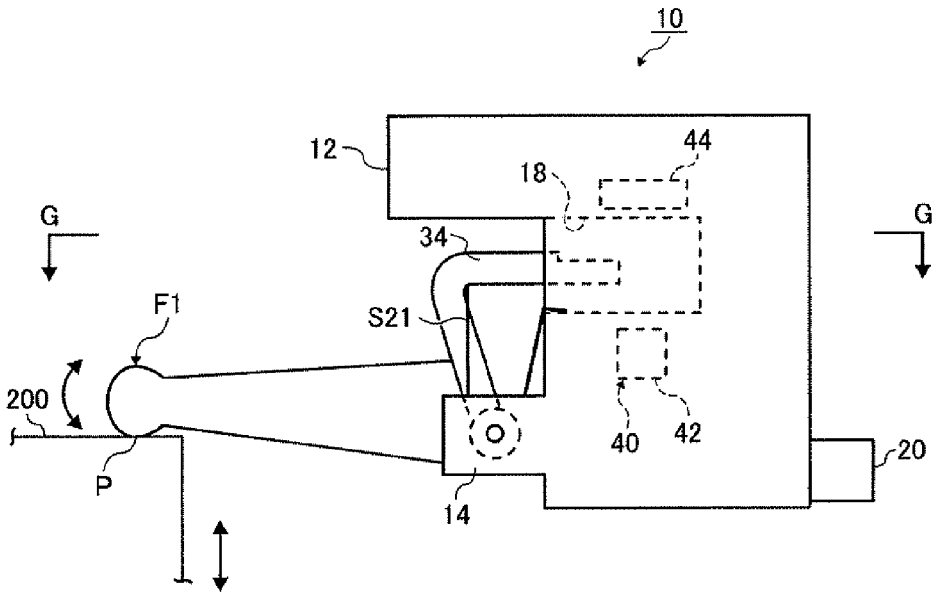
FIG. 7A is a right side view showing the position detection apparatus according to a second exemplary embodiment of the present invention.
Figure 7B:
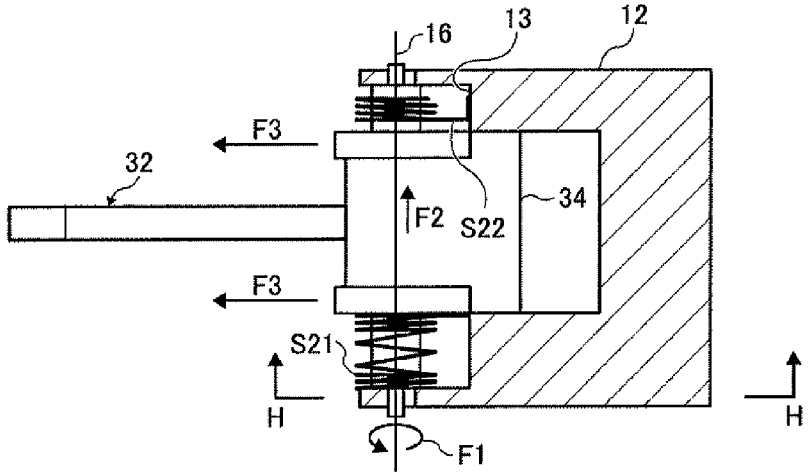
FIG. 7B is a cross-sectional view along a line G-G in FIG. 7A.

FIGS. 7A and 7B show the position detection apparatus 10 according to a second exemplary embodiment of the present invention.

As in the case of the above-described exemplary embodiment to which the present invention is applied, in the position detection apparatus 10 according to the second exemplary embodiment, the moving member 30 and the photosensor 40 are attached to the position detection apparatus main body 12.

Further, the position detection apparatus 10 according to the above-described first exemplary embodiment has three springs to press the moving member 30, i.e., the first spring S11, the second spring S12 and the third spring S13, while the position detection apparatus 10 according to the second exemplary embodiment has two springs to act on the moving member 30, i.e., a first spring S21 and a second spring S22. As shown in FIGS. 7A and 7B, the first spring S21 is positioned on the right side of the moving member 30 in the direction of the rotation shaft 16, and the second spring S22 is positioned in the left side of the moving member 30 in the direction of the rotation shaft 16. The first spring S21 and the second spring S22 are located on opposite sides of the moving member 30 in the direction of the rotation shaft 16.

The first spring S21 is used as a first pressing member to press the moving member 30 so as to cause at least one of the first force F1 as a force to press the moving member 30 against the detection object 200, the second force F2 as a force to press the moving member 30 substantially in the direction of the rotation shaft 16, and the third force F3 as a force to press the moving member in a direction substantially orthogonal to the direction of the rotation shaft 16, to act on the moving member 30. Further, the second spring S22 is used as a second pressing member to cause at least one of the forces F1, F2 and F3 to act on the moving member 30. The first spring S21 and the second spring S22 cause the first force F1, the second force F2 and the third force F3 to act on the moving member 30.

Further, the first spring S21 is used as a main pressing member having a single member to press the moving member 30 so as to cause the first force F1, the second force F2 and the third force F3 to act on the moving member 30. Further, the second spring S22 is used as an auxiliary pressing member, in the direction of the rotation shaft 16 and provided on the opposite side of the spring S21 with respect to the moving member 30, to cause at least the third force F3 to act on the moving member 30.

Figure 8:
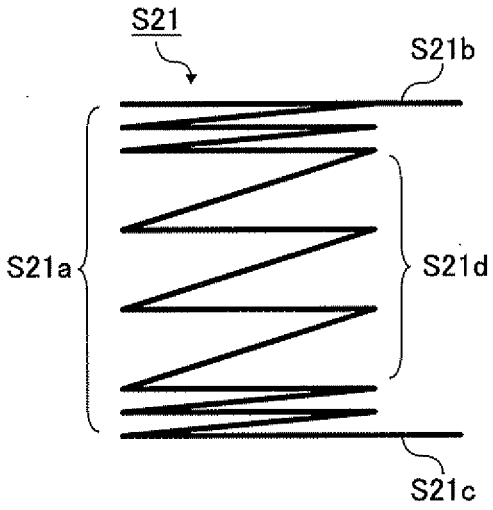
FIG. 8 is an expanded plane view showing a first spring of the position detection apparatus according to the second exemplary embodiment of the present invention.

FIG. 8 shows the first spring S21.

The first spring S21 has a torsion spring with a coil winding S21*a* of a wound metal wire, an end S21*b* at one end of the metal wire forming the coil winding S21*a*, and an end S21*c* at the other end of the metal wire. In a status where the coil winding S21*a* is twisted, the end S21*b* side is attached to the moving member 30, and the end S21*c* side is attached to the position detection apparatus main body 12. Accordingly, the first spring S21 presses the moving member 30 in a direction to release the twist and cause the first force F1 to act on the moving member 30.

Further, the first spring S21 is attached to the moving member 30 and the position detection apparatus main body 12 in a status where the end S21*c* side is elastic-deformed such that the moving member 30 is moved to a rear side (right side in FIGS. 7A and 7B) Accordingly, by the elasticity of the end S21*c*, the moving member 30 is pressed frontward, ice., in a direction to cause the third force F3 to act on the moving member 30.

Generally, a torsion spring has a non-pitch coil winding. However, a part or whole of the coil winding S21*a* is a nondense coil S21*d* in which the density of metal wire is low. The coil winding S21*a* is attached, with the right side in contact with the position detection apparatus main body 12, and with the left side in contact with the moving member 30, such that the nondense coil S21*d* is in a contracted state. Accordingly, in a general torsion spring, the coil winding is used only for holding the member, while the nondense coil S21*d* of the spring S21 presses the moving member 30 in a releasing direction, i.e., the direction to cause the second force F2 to act on the moving member 30.

As described above, the first spring S21, having a torsion spring with a function of pressing the moving member 30 in two liner directions which are orthogonal, i.e., substantially the direction of the rotation shaft 16 and the direction substantially orthogonal to the rotation shaft 16, causes the first force F1, the second force F2 and the third force F3 to act on the moving member 30.

Figure 9:
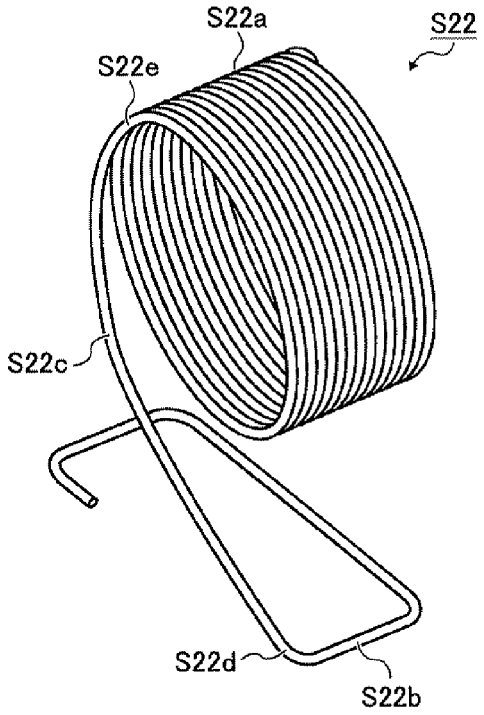
FIG. 9 is a perspective view showing a second spring of the position detection apparatus according to the second exemplary embodiment of the present invention.
Figure 10:
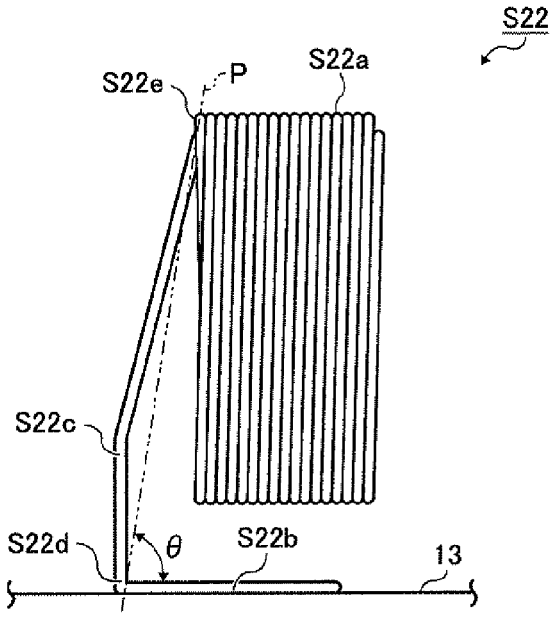
FIG. 10 is a front view showing the second spring of the position detection apparatus according to the second exemplary embodiment of the present invention.

FIGS. 9 and 10 show the second spring S22.

As shown in FIGS. 9 and 10, the second spring S22 has a holding member S22*a* to hold the moving member 30, a contact member S22*b* in contact with the position detection apparatus main body 12, and a connecting member S22*c* to connect the holding member S22*a* to the contact member S22*b*. The holding member S22*a* holds the moving member 30 such that the shafts 36 of the moving member 30 are inserted inside the coil of metal wire winding. The contact member S22*b* is a folded end of the metal wire, and has a flat surface in contact with a contact surface 13 on the front side of the position detection apparatus main body 12. The contract surface 13 is formed approximately parallel to the rotation shaft 16.

The connecting member S22*c* is elastic-deformed in a direction in which the holding member S22*a* and the contact member S22*b* become close to each other in a status where the second spring S22 is attached to the position detection apparatus main body 12 and the moving member 30. Accordingly, by the elasticity of the connecting member S22*c*, the holding member S22*a* is pushed frontward, and the moving member 30 is pressed frontward, i.e., the force F3 in the direction substantially orthogonal to the rotation shaft 16 acts on the moving member 30.

As shown in FIG. 10, an angle θ, formed with a plane P, including an end S22*d* on the contact member S22*b* side of the connecting member S22*c* and an end S22*e* on the holding member S22*a* side of the connecting member S22*c*, and the contact surface 13, is smaller than 90°. Accordingly, in comparison with a case where the angle θ is set to be equal to or larger than 90°, the second spring S22 is not easily inclined. That is, when the angle θ is set to be equal to or larger than 90°, when the second spring S22 presses the moving member 30, the second spring S22 may be rotated about the end S22*d* by a counteraction to the pressing of the moving member 30 in a direction in which the contact member S22*b* is moved away from the contact surface 13.

Figure 11:
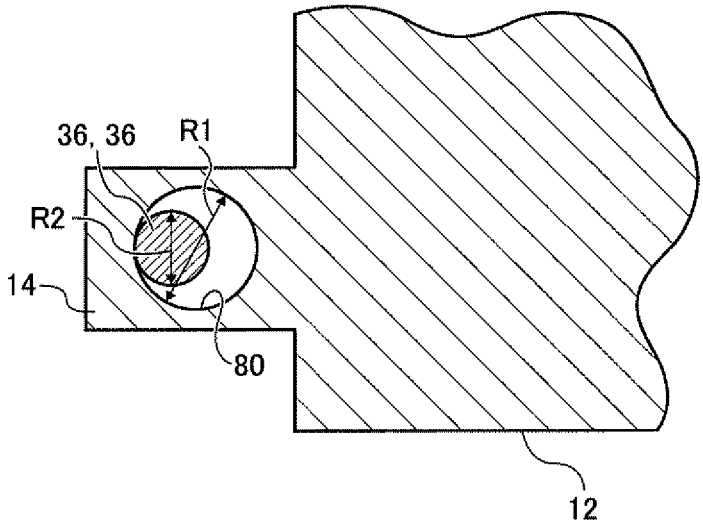
FIG. 11 is a cross-sectional view along a line H-H in FIG. 7B, showing a status where a moving member is supported with a position detection apparatus main body of the position detection apparatus according to the second exemplary embodiment of the present invention.

FIG. 11 shows a status where the moving member 30 is supported with the position detection apparatus main body 12.

As shown in FIG. 11, the right side plate 14 of the position detection apparatus main body 12 has a through hole 80. The right shaft 36 of the moving member 30 is inserted into the through hole 80, thereby the moving member 30 is supported with the position detection apparatus main body 12. A diameter R1 of the through hole 80 is larger than a diameter R2 of a portion of the shaft 36 inserted into the through hole 80.

In FIG. 11, the right shaft 36 of the moving member 30 is supported with the right side plate 14 of the position detection apparatus main body 12. Similarly, the left shaft 36 of the moving member 30 is supported with the left side plate 14 of the position detection apparatus main body 12. That is, the left side plate 14 has a through hole, and the left shaft 36 is inserted into the through hole, thereby the moving member 30 is supported with the position detection apparatus main body 12 Further, as in the case of the right side, the diameter of the through hole formed in the left side plate 14 is larger than the diameter of the left shaft 36 in a portion inserted into the through hole.

Figure 12A:
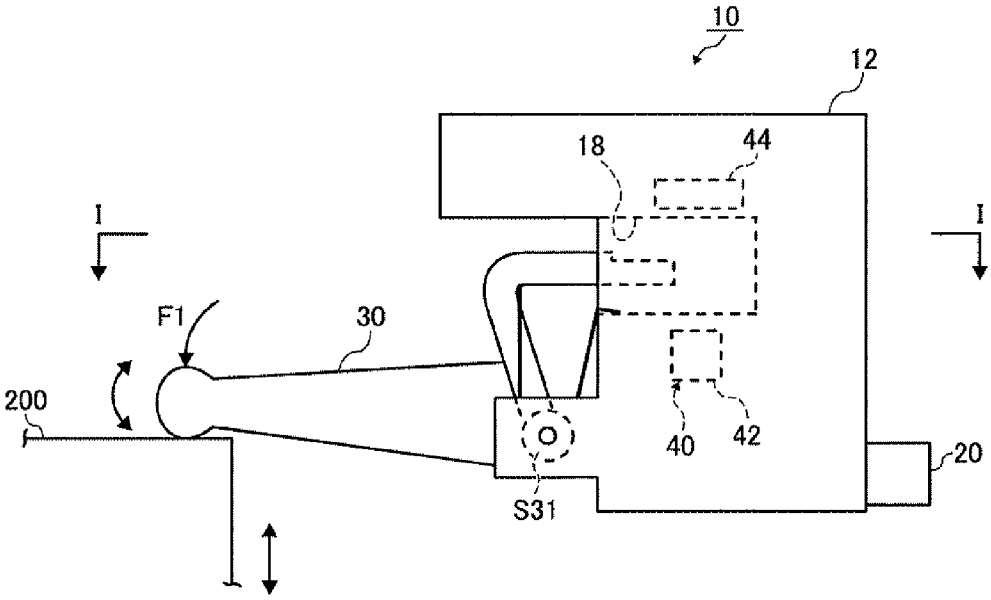
FIG. 12A is a right side view showing the position detection apparatus according to a first modification of the second exemplary embodiment of the present invention.
Figure 12B:
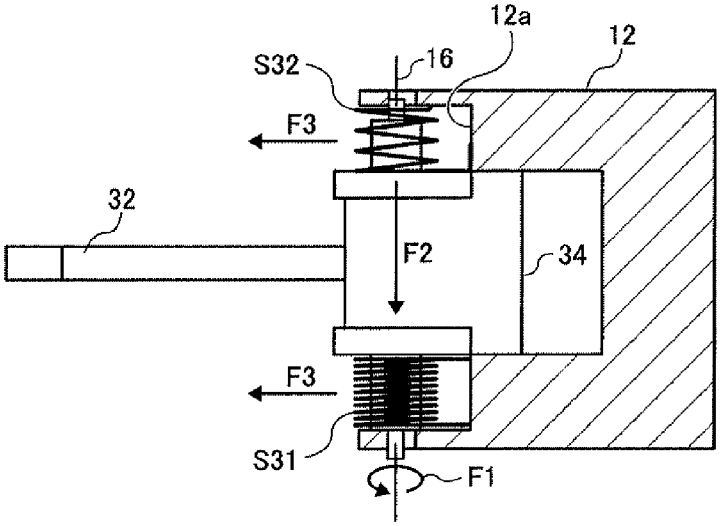
FIG. 12B is a cross-sectional view along a line I-I in FIG. 12A.

FIGS. 12A and 12B show the position detection apparatus 10 according to a first modification of the second exemplary embodiment of the present invention. In the position detection apparatus 10 according to the above-described second exemplary embodiment, the first spring S21 is attached to the right side of the moving member 30 and the second spring S22 is attached to the left side of the moving member 30. In the position detection apparatus 10 according to the first modification of the second exemplary embodiment, a first spring S31 is attached to the right side of the moving member 30, and a second spring S32 is attached to the left side of the moving member 30.

As in the case of the first spring S21 used in the above-described second exemplary embodiment, the first spring S31 is used as a first pressing member to press the moving member 30 so as to cause at least one of the first force F1 as a force to press the moving member 30 against the detection object 200, the second force F2 as a force to press the moving member 30 substantially in the direction of the rotation shaft 16, and the third force F3 as a force to press the moving member 30 in a direction substantially orthogonal to the direction of the rotation shaft 16, to act on the moving member 30. Particularly, the first spring S31 has a torsion spring having a function of pressing the attached moving member 30 in one liner direction, and is used as the first pressing member to cause the first force F1 and the third force F3 to act on the moving member 30.

As in the case of the first spring S21 used in the above-described second exemplary embodiment, one end side of the first spring S31 is attached to the moving member 30 and the other end side is attached to the position detection apparatus main body 12 in a status where a coil winding is twisted Accordingly, the first spring S31 presses the moving member 30 in a direction to release twist and cause the first force F1 to act on the moving member 30.

Further, as in the case of the first spring S21 used in the above-described second exemplary embodiment, the first spring S31 is attached to the moving member 30 and the position detection apparatus main body 12 in a status where the coil winding is elastic-deformed such that the moving member 30 is moved to the rear side (right side in FIGS. 12A and 12B). Accordingly, by the elasticity, the moving member 30 is pressed frontward, i.e., in a direction to cause the third force F3 to act on the moving member 30.

As described above, the first spring S31, having the torsion spring with a function of pressing the moving member 30 in one linear direction, presses the moving member 30 so as to cause the first force F1 and the second force F2 to act on the moving member 30.

The second spring S32, having a coil spring, presses the moving member 30 to the right side, i.e., in a direction to cause the second force F2 to act on the moving member 30, by its function of the coil spring. Further, the second spring S32 is attached to the moving member 30 and the position detection apparatus main body 12 in a status where one end side of the metal wire forming the coil is in contact with the contact surface 13 of the position detection apparatus main body 12 and the coil winding is elastic-deformed so as to move to the contact surface 13 side. Accordingly, the second spring S32 presses the moving member 30 frontward, i.e., in a direction to cause the third force F3 to act on the moving member 30.

As described above, the second spring S32, having a spring with a function of pressing the moving member 30 in two liner directions which are orthogonal, i.e., substantially the direction of the rotation shaft 16 and the direction substantially orthogonal to the rotation shaft 16, presses the moving member 30 so as to cause the second force F2 and the third force F3 to act on the moving member 30.

Figure 13A:
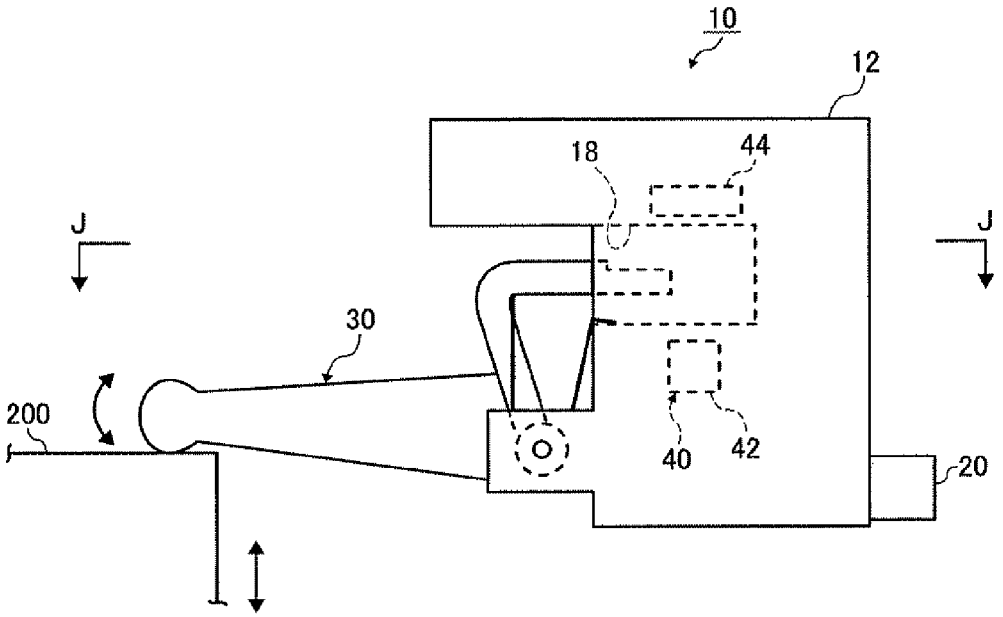
FIG. 13A is a right side view showing the position detection apparatus according to a second modification of the second exemplary embodiment of the present invention.
Figure 13B:
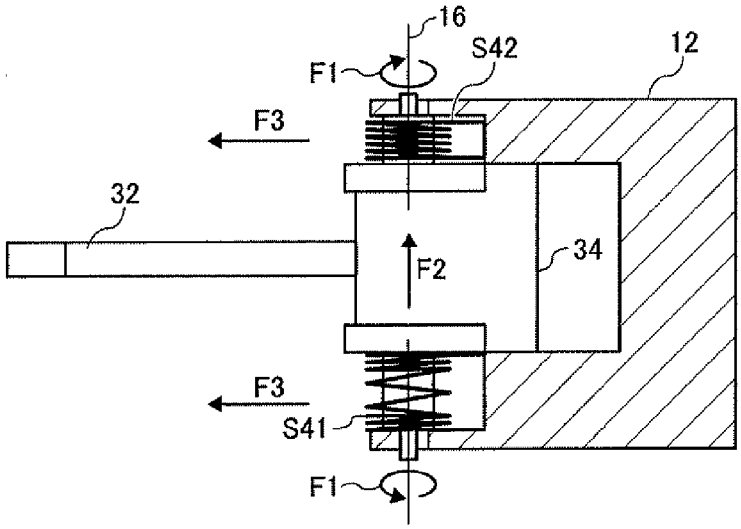
FIG. 13B is a cross-sectional view along a line J-J in FIG. 13A.

FIGS. 13A and 13B show the position detection apparatus 10 according to a second modification of the second exemplary embodiment of the present invention. In the position detection apparatus 10 according to the above-described second exemplary embodiment, the first spring S21 is attached to the right side of the moving member 30, and the second spring S22 is attached to the left side of the moving member 30. In the position detection apparatus 10 according to the second modification of the second exemplary embodiment, a first spring S41 is attached to the right side of the moving member 30, and a second spring S42 is attached to the left side of the moving member 30.

As in the case of the first spring S21 used in the above-described second exemplary embodiment, the first spring S41 has a torsion spring with a function of pressing the moving member 30 in two linear directions which are orthogonal, i.e., substantially the direction of the rotation shaft 16 and the direction substantially orthogonal to the rotation shaft 16. The first spring S41 presses the moving member 30 so as to cause the first force F1, the second force F2 and the third force F3 to act on the moving member 30.

The second spring S42 has a torsion spring with a function of pressing an attached object in one linear direction. One end side of the second spring S42 is attached to the moving member 30 and the other end side is attached to the position detection apparatus main body 12 in a status where a coil winding is twisted. Accordingly, the second spring S42 presses the moving member 30 in a direction to release the twist and cause the first force F1 to act on the moving member 30. Further, the second spring S42 is attached to the moving member 30 and the position detection apparatus main body 12 in a status where it is elastic-deformed such that the moving member 30 is moved to the rear side (right side in FIGS. 12A and 12B). Accordingly, by the elasticity of the end of metal wire connected from the coil winding, the moving member 30 is pressed frontward, i.e., in the direction in which the third force F3 is caused to act on the moving member 30.

As described above, in the position detection apparatus 10 according to the second modification of the second exemplary embodiment of the present invention, the first spring S41 presses the moving member 30 so as to cause the first force F1, the second force F2 and the third force F3 to act on the moving member 30, and the second spring S42 presses the moving member 30 so as to cause the first force F1 and the third force F3 to act on the moving member 30. In this manner, as the first spring S41 and the second spring S42 both cause the first force F1 to act on the moving member 30, the first force F1 is applied to the moving member 30 from two positions on opposite sides of the moving member 30 in the direction of the rotation shaft 16.

Figure 14A:
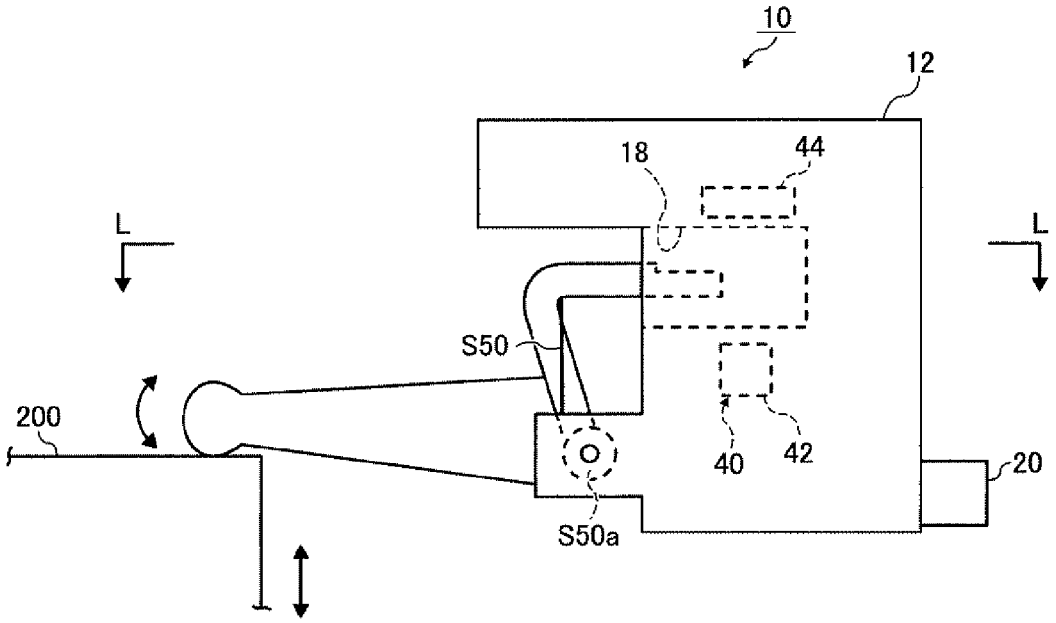
FIG. 14A is a right side view showing the position detection apparatus according to a third exemplary embodiment of the present invention.
Figure 14B:
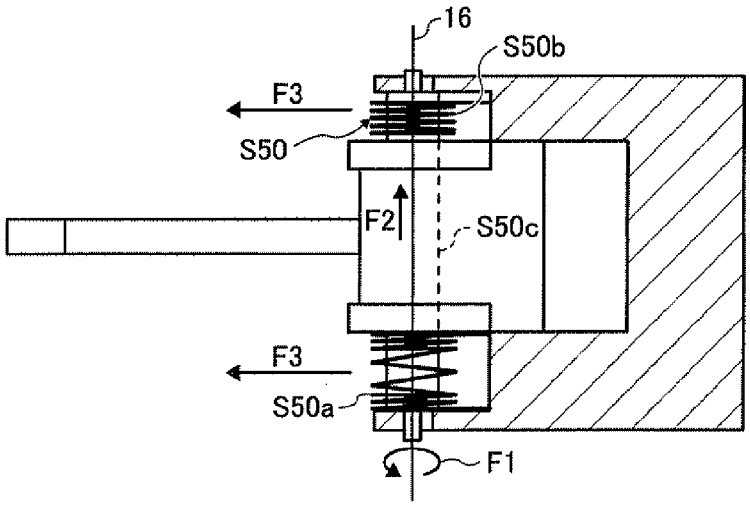
FIG. 14B is a cross-sectional view along a line L-L in FIG. 14A.

FIGS. 14A and 14B show the position detection apparatus 10 according to a third exemplary embodiment of the present invention.

In the above-described first exemplary embodiment and the modifications of the first exemplary embodiment, three springs are used, and in the above-described second exemplary embodiment, two springs are used. In the position detection apparatus 10 according to the third exemplary embodiment, one spring S50 is used.

The spring S50 is used as a main pressing member having a single member to press the moving member 30 so as to cause the first force F1, the second force F2 and the third force F3 to act on the moving member 30. The spring S50 has a first coil winding S50*a*, a second coil winding S50*b*, and a connecting member S50*c* connecting the first coil winding S50*a* to the second coil winding S50*b*. These members are formed by bending one metal wire.

The first coil winding S50*a*, having approximately the same shape of the above-described first spring S21 (see FIGS. 7A and 7B), has a nondense coil in which the density of metal wire is low. Accordingly, the moving member 30 is pressed by the first coil winding S50*a* to be acted on by the second force F2. Further, the first coil winding S50*a* is attached to the moving member 30 and the position detection apparatus main body 12 in a status where the end side of the metal wire projected from the coil winding S50*a* is in contact with the position detection apparatus main body 12 and the end side is elastic-deformed such that the coil winding S50*a* is moved to the rear side. Accordingly, by the elasticity of the end side of the metal wire, the moving member 30 is pressed frontward, i.e., in a direction where the third force F3 acts on the moving member 30. Further, the first coil winding S50*a* has a torsion spring. Accordingly, the moving member 30 is pressed to receive the first force F1 by the function as a torsion spring of the winding S50*a*.

The second coil winding S50*b* is provided on the opposite side of the first coil winding S50*a* with respect to the moving member 30 in the direction of the rotation shaft 16. The second coil winding S50*b* presses the moving member 30 so as to cause the third force F3 to act on the moving member 30. As described above, the moving member 30 is pressed by the first coil winding S50*a* to be acted on by the first force F1, the second force F2 and the third force F3, and is pressed by the second coil winding S50*b* to be acted on by the third force F3.

Figure 15:
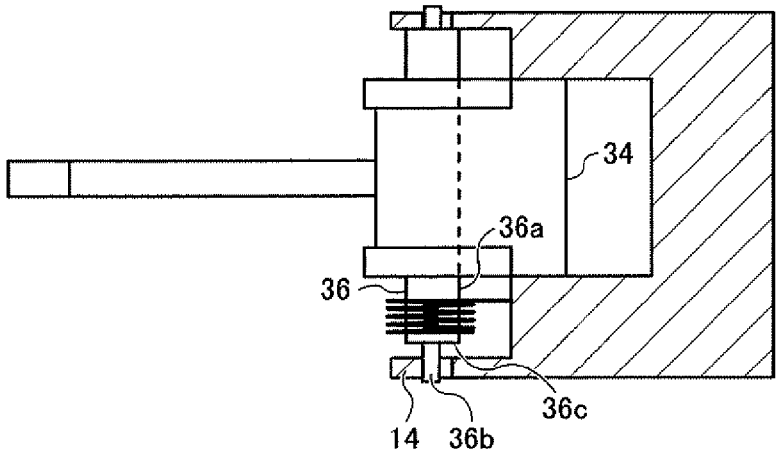
FIG. 15 is a plan view showing a position in which the spring acts on the moving member in each of the position detection apparatuses according to the first to third exemplary embodiments and the modifications of the first to third exemplary embodiments of the present invention.

FIG. 15 shows a state in which the moving member 30 is pressed by the spring in the position detection apparatuses 10 according to the second exemplary embodiment and the third exemplary embodiment of the present invention and the modifications of the second and third exemplary embodiments.

In FIG. 15 showing the right shaft 36, when a spring S is attached to the shaft 36, the shaft 36 has a large diameter member 36*a* on the side of the detected plate 34 used as a main body and a small diameter member 36*b* positioned on the side of the side plate 14 from the large diameter member 36*a* having a diameter smaller than the large diameter member 36*a*, with a step member 36*c* between the small diameter member and the large diameter member 36*a*, the spring S desirably applies its force on the detected plate 34 side of the large diameter member 36*a*.

Figure 16:
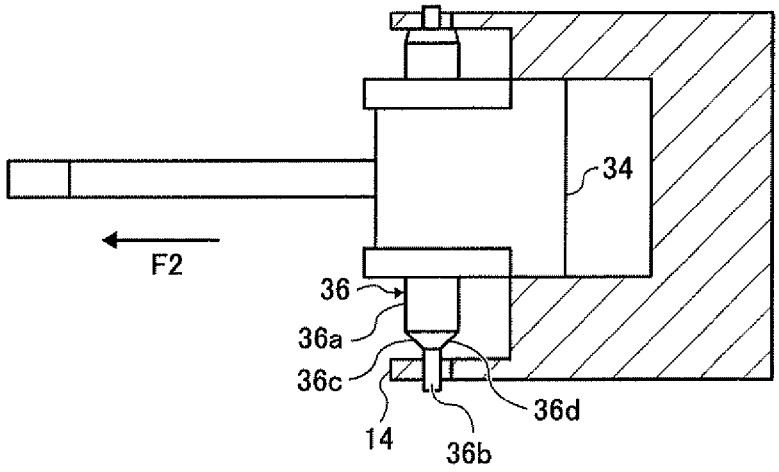
FIG. 16 is a plan view showing a shape of the moving member of the position detection apparatuses according to the first to third exemplary embodiments and the modifications of the first to third exemplary embodiments of the present invention.

FIG. 16 shows a desirable shape of the shaft 36 of the moving member 30 in the position detection apparatuses 10 according to the second exemplary embodiment and the third exemplary embodiment of the present invention and the modifications of the second and third exemplary embodiments.

In FIG. 16 showing the right shaft 36, when the shaft 36 has the large diameter member 36*a* on the side of the detected plate 34 used as a main body and the small diameter member 36*b* positioned on the side of the side plate 14 from the large diameter member 36*a* having a diameter smaller than the large diameter member 36*a*, with a step member 36*c* between the small diameter member and the large diameter member 36*a*, a chamfer member 36*d* may be formed in the step member 36*c*. The chamfer member 36*d* may be formed by an R-surface process of round chamfering or a C-surface process of linear cutting of ridge line.

Figure 17:
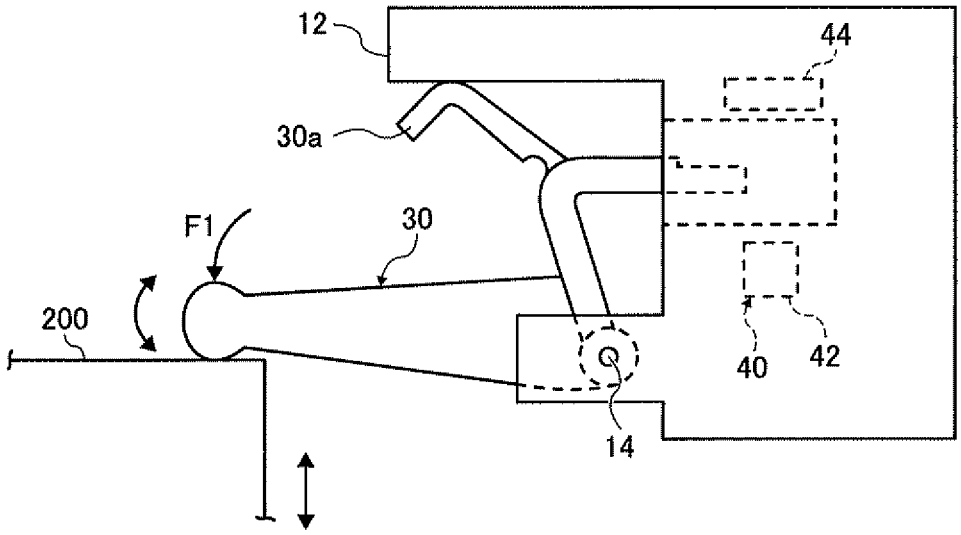
FIG. 17 is a right side view showing the position detection apparatus according to a fourth exemplary embodiment of the present invention.

FIG. 17 shows the position detection apparatus 10 according to a fourth exemplary embodiment of the present invention.

In the position detection apparatuses 10 according to the above-described first to third exemplary embodiments and the modifications of the first to third exemplary embodiments, the first force F1, the second force F2 and the third force F3 are applied to the moving member 30 by the action of single or plural springs. In the fourth exemplary embodiment, a part or whole of the moving member 30 is formed of an elastic body, and at least one of the first force F1, the second force F2 and the third force F3 is generated by elasticity.

As shown in FIG. 17, in the position detection apparatus 10 according to the fourth exemplary embodiment, the moving member 30 has a contact member 30*a* projected upward. When the moving member 30 comes into contact with the detection object 200, the contact member 30*a* comes into contact with the faced-down surface of the position detection apparatus main body 12 and slightly elastic-deformed. Then, the first force F1 acts on the moving member 30 by the elasticity of the contact member 30*a*. Further, the second force F2 and the third force F3 act on the moving member 30 with single or plural springs (not shown).

Figure 18:
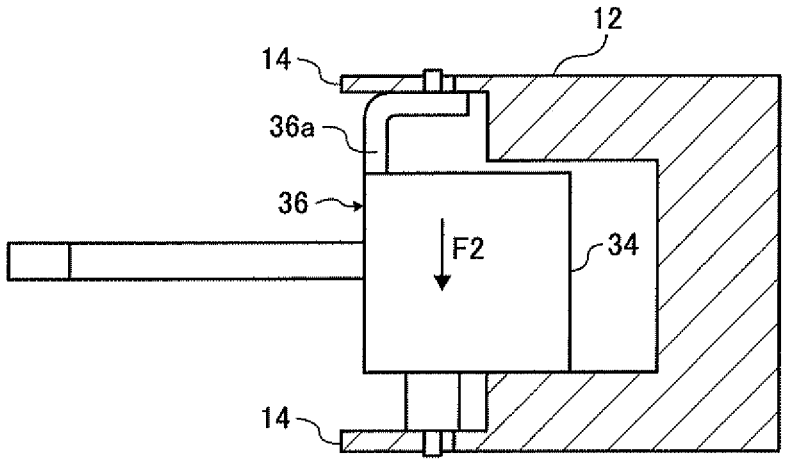
FIG. 18 is a cross-sectional view showing the position detection apparatus according to a first modification of the fourth exemplary embodiment of the present invention.

FIG. 18 shows the position detection apparatus 10 according to a first modification of the fourth exemplary embodiment of the present invention. In the position detection apparatus 10 according to the above-described fourth exemplary embodiment, the moving member 30 has the upward-projected contact member 30*a*, and the first force F1 acts on the moving member 30 by the elasticity of the contact member 30*a*.

In the first modification of the fourth exemplary embodiment, the contact member 30*a* is provided on the left side part of the moving member 30, and in contact with the left side plate 14 of the position detection apparatus main body 12 in a slightly elastic-deformed state. Accordingly, the moving member 30 is acted on by the second force F2 toward the right side as shown in FIG. 18.

Figure 19:
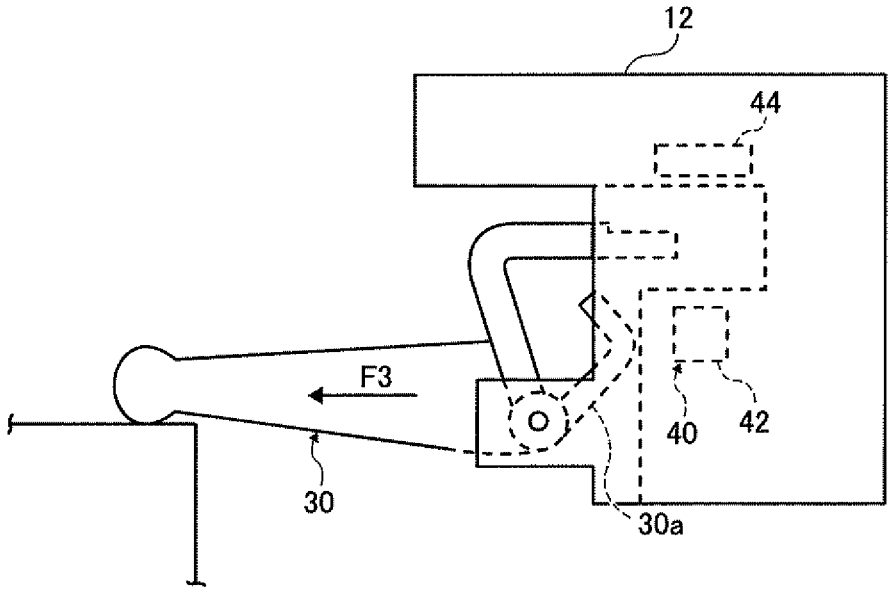
FIG. 19 is a right side view showing the position detection apparatus according to a second modification of the fourth exemplary embodiment of the present invention.

FIG. 19 shows the position detection apparatus 10 according to a second modification of the fourth exemplary embodiment of the present invention. In the position detection apparatus 10 according to the above-described fourth exemplary embodiment, the moving member 30 has the upward-projected contact member 30*a*, and the first force F1 acts on the moving member 30 by the elasticity of the contact member 30*a*.

In the second modification of the fourth exemplary embodiment, the contact member 30*a* is projected toward the rear side of the moving member 30, and in contact with the frontward surface of the position detection apparatus main body 12 in a slightly elastic-deformed state. Accordingly, the moving member 30 is acted on by the third force F3 by the elasticity of the contact member 30*a*. Note that the contact member 30*a* is a plate member in which a portion in contact with the position detection apparatus main body 12 is bent frontward.

Figure 20:
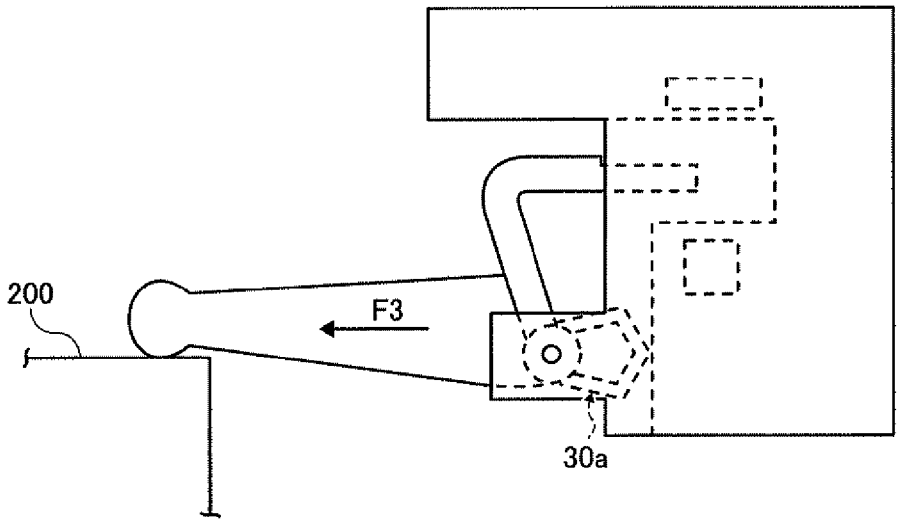
FIG. 20 is a right side view showing the position detection apparatus according to a third modification of the fourth exemplary embodiment of the present invention.

FIG. 20 shows the position detection apparatus 10 according to a third modification of the fourth exemplary embodiment of the present invention. In the position detection apparatus 10 according to the above-described second modification of the fourth exemplary embodiment, the contact member 30*a* is a plate member in which a portion in contact with the position detection apparatus main body 12 is bent frontward, and its one side is attached to the moving member 30. In the position detection apparatus 10 according to the third modification of the fourth exemplary embodiment of the present invention, the contact member 30*a* is a bent or distorted plate and its two sides are attached to the moving member 30. The moving member 30 is acted on by the third force F3 frontward by the elasticity of the contact member 30*a*.

Figure 21:
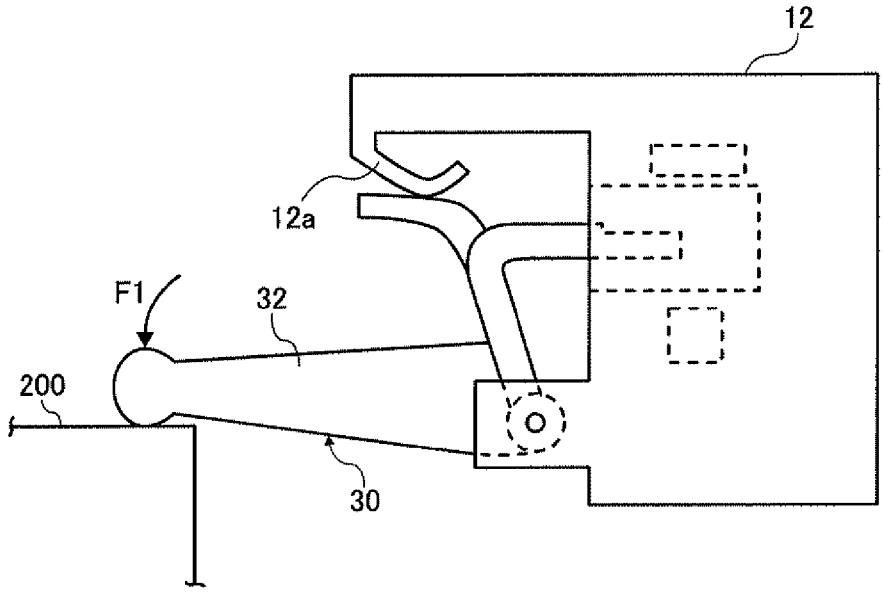
FIG. 21 is a right side view showing the position detection apparatus according to a fifth exemplary embodiment of the present invention.

FIG. 21 shows the position detection apparatus 10 according to a fifth exemplary embodiment of the present invention In the above-described fourth exemplary embodiment, a part or whole of the moving member 30 is formed of an elastic body, and at least one of the first force F1, the second force F2 and the third force F3 is generated by the elasticity. In the position detection apparatus 10 according to the fifth exemplary embodiment, a part or whole of the position detection apparatus main body 12 is formed of an elastic body, and at least one of the first force F1, the second force F2 and the third force F3 is generated by the elasticity.

As shown in FIG. 21, in the position detection apparatus 10 according to the fifth exemplary embodiment, the position detection apparatus main body 12 has a contact member 12*a* projected downward, and when the contact plate 32 is brought into contact with the detection object 200, the contact member 12*a* comes into contact with the moving member 30, and the contact member 12*a* is slightly elastic-deformed. Then, the moving member 30 rotates about the rotation shaft 16 by the elasticity of the contact member 12*a*, and the first force F1 acts on the moving member 30. Further, the second force F2 and the third force F3 act on the moving member 30 by single or plural springs (not shown).

Figure 22:
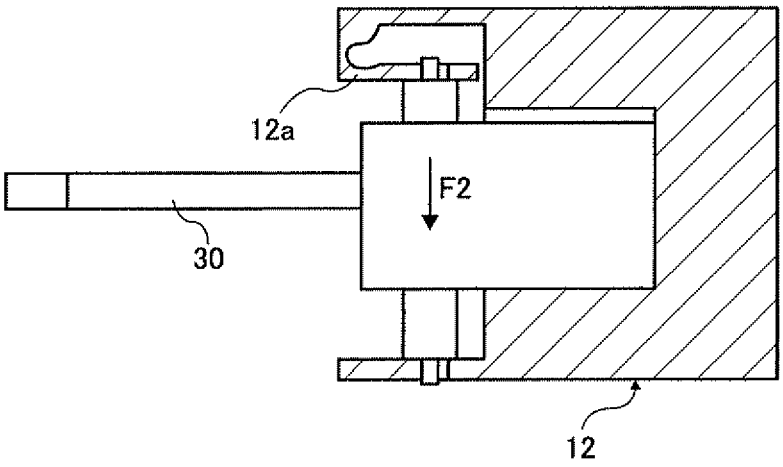
FIG. 22 is a right side view showing the position detection apparatus according to a first modification of the fifth exemplary embodiment of the present invention.

FIG. 22 shows the position detection apparatus 10 according to a first modification of the fifth exemplary embodiment of the present invention. In the position detection apparatus 10 according to the above-described fifth exemplary embodiment, the position detection apparatus main body 12 has the contact member 12*a* projected downward, and the moving member 30 is pressed such that the first force F1 acts on the moving member 30 by the elasticity of the contact member 12*a*.

In the first modification of the fifth exemplary embodiment, the contact member 12*a* is provided in a left side part of the position detection apparatus main body 12, and is in contact with the moving member 30 in a slightly elastic-deformed state. Accordingly, the moving member 30 is pressed rightward so as to be acted on by the second force F2 as shown in FIG. 22.

Figure 23:
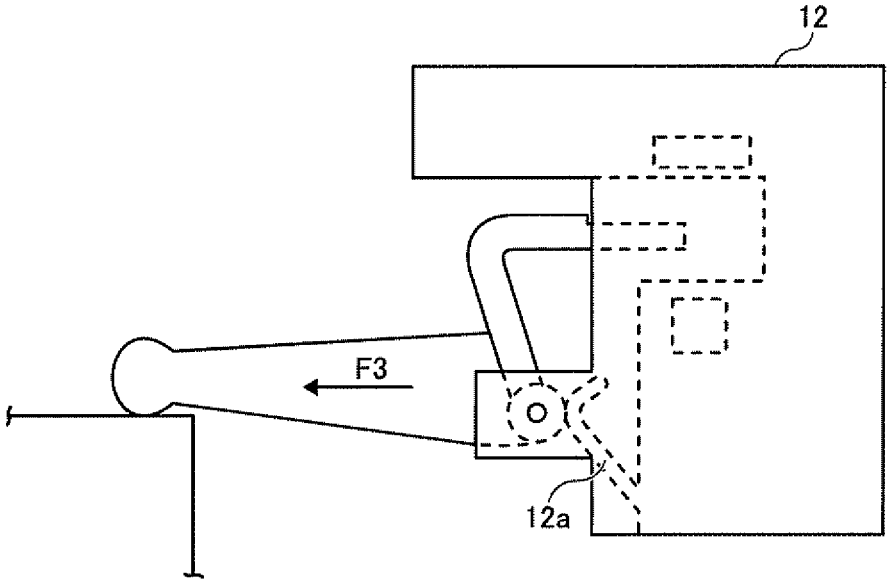
FIG. 23 is a right side view showing the position detection apparatus according to a second modification of the fifth exemplary embodiment of the present invention.

FIG. 23 shows the position detection apparatus 10 according to a second modification of the fifth exemplary embodiment of the present invention. In the position detection apparatus 10 according to the above-described fifth exemplary embodiment, the position detection apparatus main body 12 has the contact member 12*a* projected downward, and the moving member 30 is pressed such that the first force F1 acts on the moving member 30 by the elasticity of the contact member 12*a*.

In the second modification of the fifth exemplary embodiment, the contact member 30*a* is provided in the position detection apparatus main body 12 so as to be projected frontward to the moving member 30, and is in contact with the moving member 30 in a slightly elastic-deformed state. Accordingly, the moving member 30 is acted on by the third force F3 frontward by the elasticity of the contact member 12*a*.

Figure 24B:
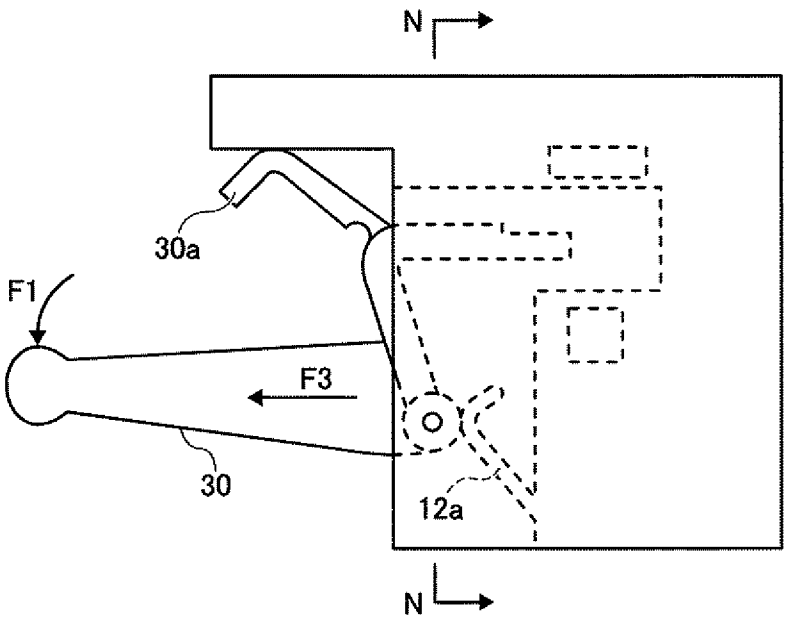
FIG. 24B is a right side view showing the position detection apparatus according to a sixth exemplary embodiment of the present invention.
Figure 24A:
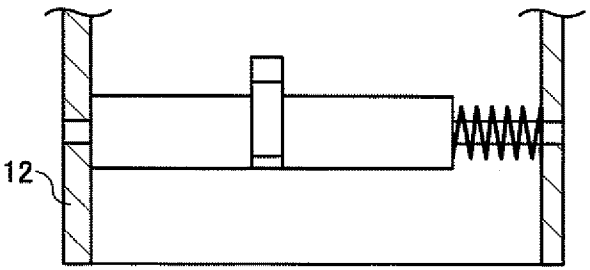
FIG. 24A is a cross-sectional view along a line N-N in FIG. 24B.

FIGS. 24A and 24B show the position detection apparatus 10 according to a sixth exemplary embodiment of the present invention.

In the sixth exemplary embodiment, a part or whole of the moving member 30 is formed of an elastic body. At least one of the first force F1, the second force F2 and the third force F3 is generated by the elasticity. Further, a part of the position detection apparatus main body 12 is formed of an elastic body, and at least one of the first force, the second force and the third force is generated by the elasticity.

As shown in FIGS. 24A and 24B, in the position detection apparatus 10 according to the sixth exemplary embodiment, the moving member 30 has the contact member 30*a* projected upward. When the moving member 30 is brought into contact with the detection object 200, the contact member 30*a* comes into contact with a faced-down surface of the contact plate 32 and is slightly elastic-deformed. Then, the moving member 30 rotates about the rotation shaft 16 by the elasticity of the contact member 30*a*, and the first force F1 acts on the moving member 30.

Further, the position detection apparatus main body 12 has the contact member 12*a* projected frontward to the moving member 30. The contact member 12*a* is in contact with the moving member 30 in a slightly elastic-deformed state. Accordingly, the moving member 30 is acted on by the third force F3 frontward by the elasticity of the contact member 12*a*.

Figure 25:
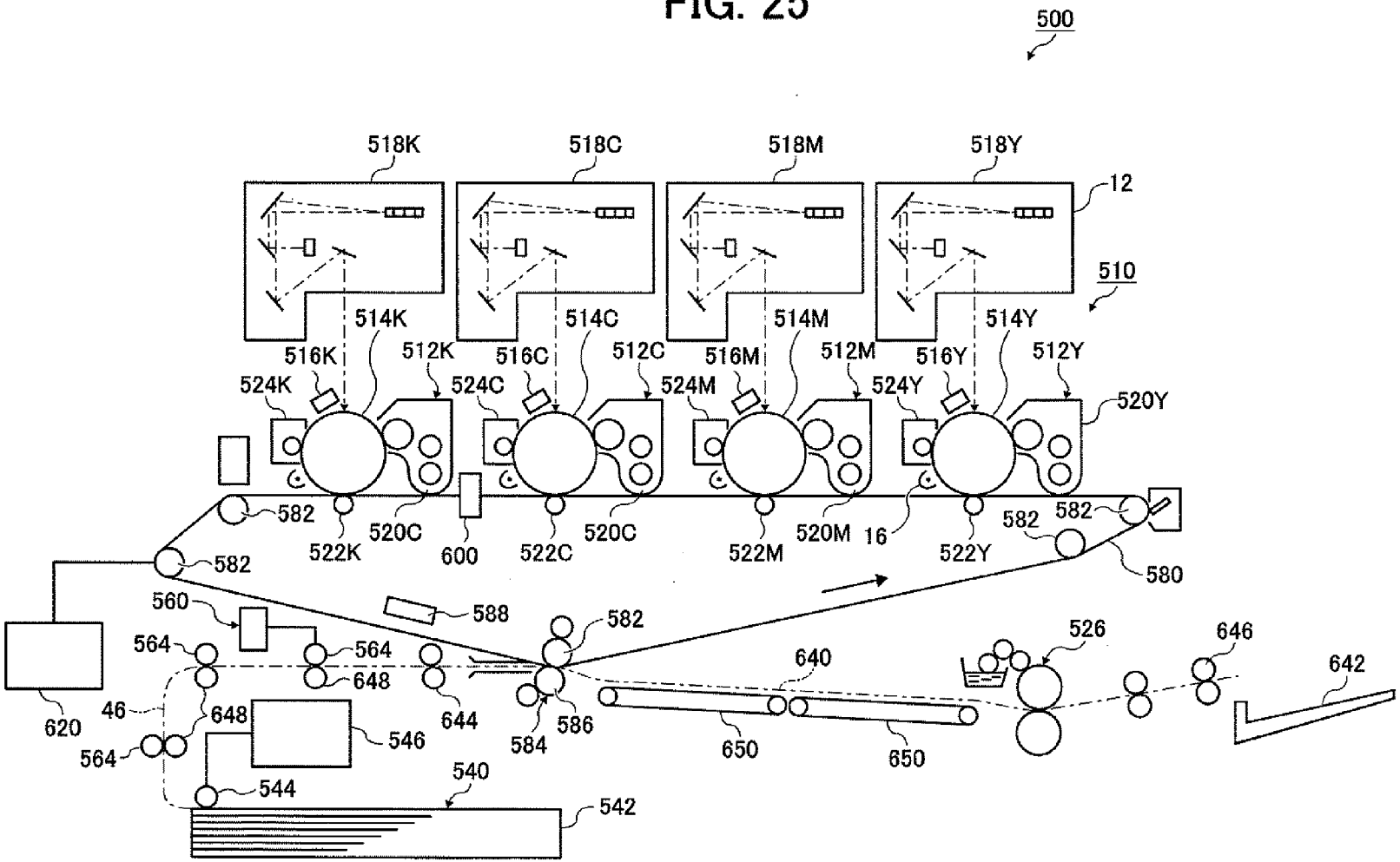
FIG. 25 is a front view showing the configuration of an image forming apparatus according to another exemplary embodiment of the present invention.

FIG. 25 shows an image forming apparatus 500 according to another exemplary embodiment of the present invention.

The image forming apparatus 500 has an image forming unit 510 to form a toner image, a supply device 540 to supply paper to the image forming unit 510, a paper thickness detection apparatus 560 to detect the thickness of the paper supplied from the supply device 540, a conveyance belt 580 used as a conveyance member to convey at least one of toner and paper on which a toner image is transferred, a belt position detection apparatus 600 to detect a positional change of the conveyance belt 580, and a position correction device 620 to correct the position of the conveyance belt 580. Note that as the paper thickness detection apparatus 560 and the belt position detection apparatus 600, the position detection apparatus 10 according to any one of the above-described exemplary embodiments is used. Further, a conveyance passage 640 as a path on which paper is conveyed is formed in the image forming apparatus 500.

The image forming unit 510 has toner image forming units 512Y, 512M, 512C and 512K to form a yellow toner image, a magenta toner image, a cyan toner image and a black toner image, respectively. Since the toner image forming units 512Y, 512M, 512C and 512K have the same structure though the colors of toner and the colors of toner images handled in these units are different, hereinbelow, they will be described as a toner image forming unit 512. In FIG. 25, alphabets Y, M, C and B are given to elements corresponding to the respective colors.

The toner image forming unit 512 has a photoreceptor 514 used as an image holder, a charging device 516 to uniformly charge the surface of the photoreceptor 514, a latent image forming device 518 to form an electrostatic latent image by emitting light on the surface of the photoreceptor 514 uniformly charged by the charging device 516, a developing device 520 to develop the latent image formed by the latent image forming device 518 with toner, a first transfer device 522 to transfer the toner image on the surface of the photoreceptor 514 developed by the developing device 520 onto the conveyance belt 580, and a cleaning device 524 to remove toner remaining on the surface of the photoreceptor 514, from which the toner image has been transferred by the first transfer device 522, thereby to clean the photoreceptor 514.

The supply device 540 has a container 542 containing paper, and a feed roller 544 to separate top paper in the container 542 from other paper and feed the separated paper toward the downstream side in a paper conveyance direction. The feed roller 544 is connected to a drive mechanism 546 having a drive source such as a motor. Accordingly, the feed roller 544 feeds paper when the drive mechanism 546 is ON, and stops paper feed when the drive mechanism 546 is OFF.

The conveyance belt 580, which is e.g. an endless belt, is rotatably supported with plural support rollers 582. At least one of the plural support rollers 582 is used as a drive roller to transmit drive to the conveyance belt 580. The conveyance belt 580 receives the drive transmission from the drive roller, and is rotated in an arrow direction shown in FIG. 25. Further, a second transfer device 584, for second transfer of the toner image transferred from the toner image forming unit 512 to paper, is provided on an outer surface of the conveyance belt 580 and on the side where the toner image is transferred from the toner image forming unit 512. The second transfer device 584 has a second transfer roller 586 which is brought into contact with or away from the conveyance belt 580.

Further, a rotation position detection device 588 to detect the position of the conveyance belt 580 in its rotation direction and detect the home position of the conveyance belt 580 is provided in e.g. an inner position of the conveyance belt 580.

The conveyance passage 640 is used for conveyance of the paper fed from the above-described feed roller 544 to a discharge member 642 on which paper is discharged. Along the conveyance passage 640, a registration roller 644, the above-described second transfer roller 586, a fixing device 526, and a discharge roller 646 are provided from the upstream side in the paper conveyance direction.

The registration roller 644 is used for paper supply to the second transfer device 584 in synchronization with timing of conveyance of a toner image formed by the image forming unit 510 by the conveyance belt 580 to the position of the second transfer device 584. The fixing device 526 is used for fixing the toner image, second-transferred by the second transfer device 584 to the paper, to the paper. The discharge roller 646 is used for discharging the paper, on which the toner image has been fixed by the fixing device 526, to the discharge member 642.

Further, on the conveyance passage 640, a conveyance roller 648 used for paper conveyance is provided in e.g. plural positions from the feed roller 544 to the registration roller 644. The conveyance rollers 648 are in contact with respective driven rollers 564 positioned on the opposite side of the conveyance passage 640. Further, on the conveyance passage 640, a conveyance device 650 to convey paper, on which an unfixed toner image is transferred, while holding the paper from the surface opposite to the surface on which the toner image is transferred, is provided in e.g. plural positions from the second transfer device 584 to the position of the fixing device 526.

A position correction device 620 is used for correction of the position of the conveyance belt 580 in a direction substantially orthogonal to its moving direction. Further, the position correction device 620 is connected to the support roller 582, provided on the immediately upstream side of the support roller 582 used as a backup roller for the second transfer roller 586 in the moving direction of the conveyance belt 580. The position correction device 620 corrects the position of the conveyance belt 580 by changing the angle of the support roller 582.

In the image forming apparatus 500 having the above configuration, a yellow toner image, a magenta toner image, a cyan toner image and a black toner image formed by the toner image forming units 512Y, 512M, 512C and 512K are sequentially transferred onto the conveyance belt 580, thus a toner image is formed with toner of four colors on the surface of the conveyance belt 580. The four-color toner image is second-transferred by the second transfer device 584 to paper supplied from the registration roller 644 at predetermined timing. The toner image second-transferred on the paper is fixed by the fixing device 526 to the paper, and the paper on which the toner image is fixed is discharged by the discharge roller 646 to the discharge member 64.

Figure 26:
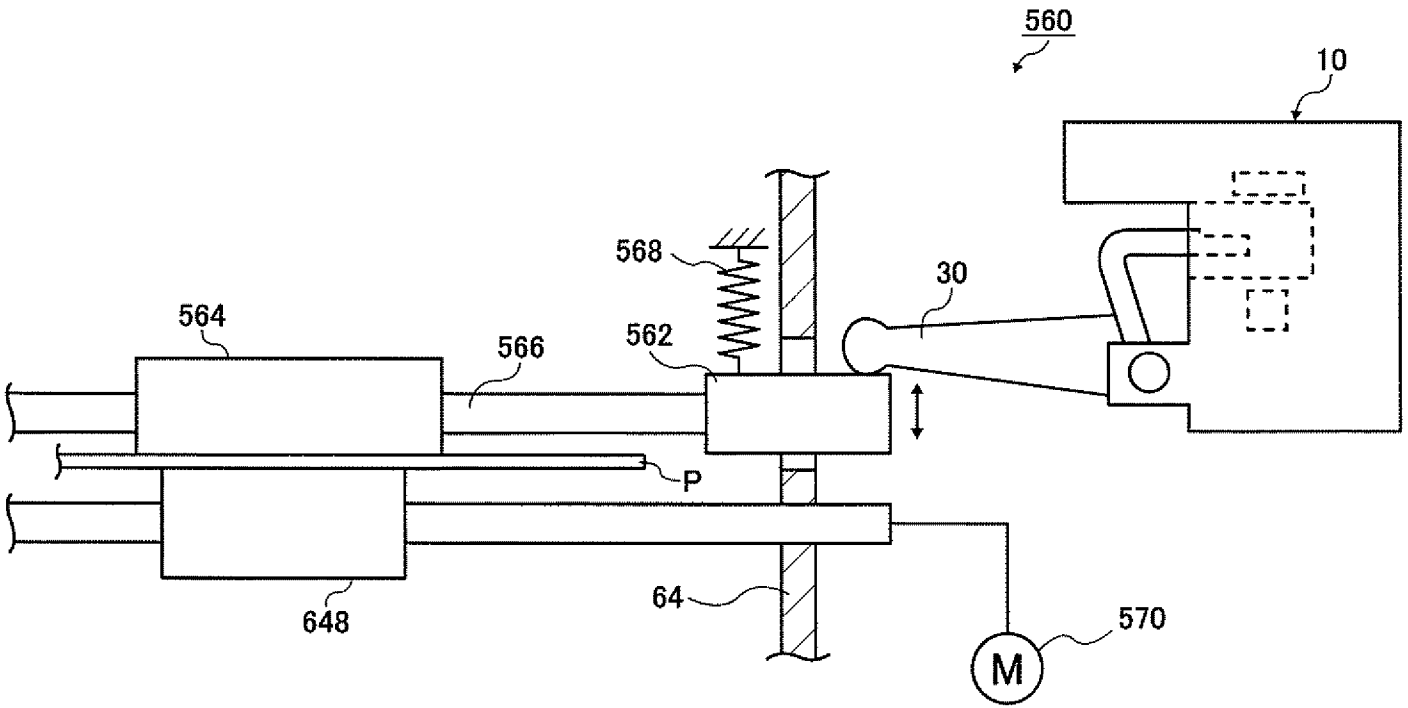
FIG. 26 is a left side view showing the structure of a paper thickness detection apparatus in the image forming apparatus according to the exemplary embodiment of the present invention.

FIG. 26 shows the paper thickness detection apparatus 560.

The paper thickness detection apparatus 560 has one of the above-described conveyance rollers 648, the driven roller 564 in contact with the conveyance roller 648, the position detection apparatus 10, and a moving member 562.

As the position detection apparatus 10, one of the position detection apparatuses 10 according to any one of the above-described exemplary embodiments may be used. The moving member 562 is provided on a shaft 566 of the driven roller 564. The driven roller 564 is pressed by a pressing member 568 having e.g. a coil spring against the conveyance roller 648, and supported with e.g. a main body frame 64 such that a distance to the conveyance roller 648 can be changed. In FIG. 26, an arrow indicates the change of the distance from the driven roller 564 to the conveyance roller 648.

The conveyance roller 648 is rotatably supported with the same member as the member to movably support the driven roller 564 such as the main body frame 64, and the conveyance roller 648 is connected to a drive source 570 having e.g. a motor. Further, the moving member 562 is in contact with the moving member 30 of the position detection apparatus 10. The moving member 30 moves following movement of the driven roller 564.

As described above, the driven roller 564 is pressed against the conveyance roller 648, and used as a moving member to move, when paper P passes between the driven roller and the conveyance roller 648, in a direction away from the conveyance roller 648 in correspondence with the thickness of the paper P. The driven roller 564, integrally with the shaft 566 and the moving member 562, is moved in the direction away from the conveyance roller 648 against the pressing by the pressing member 568. Then the position of the moving member 30 which moves following the movement of the moving member 562 is detected by the position detection apparatus 10, thereby the thickness of the paper P is detected.

Note that in FIG. 25, the paper thickness detection apparatus 560 is provided on the driven roller 564 provided immediately upstream side of the registration roller 644, however, the paper thickness detection apparatus 560 may be provided on another driven roller 564.

Figure 27:
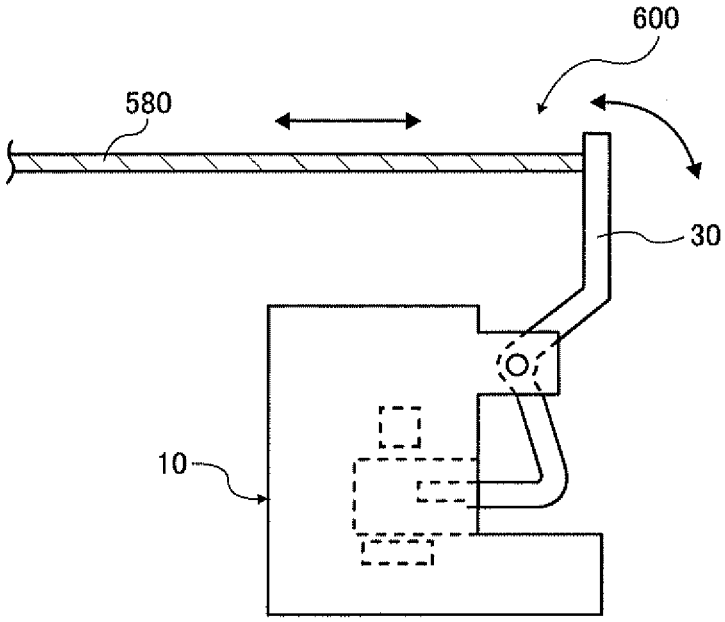
FIG. 27 is a left side view showing a belt position detection apparatus in the image forming apparatus according to the exemplary embodiment of the present invention.

FIG. 27 shows the belt position detection apparatus 600.

The belt position detection apparatus 600 has one of the position detection apparatuses 10 according to the above-described exemplary embodiments, and the moving member 30 of the position detection apparatus 10 is pressed against a side end of the conveyance belt 580. Accordingly, as indicated with an arrow in FIG. 27, when the conveyance belt 580 moves in a direction substantially orthogonal to a toner image conveyance direction, the moving member 30 moves following the movement of the conveyance belt 580.

In the belt position detection apparatus 600 having the above arrangement, the position of the moving member 30 to move following the positional change of the conveyance belt 580 is detected by the position detection apparatus 10, thereby the position of the conveyance belt 580 is detected. Note that in FIG. 25, the belt position detection apparatus 600 is provided between the toner image forming unit 512C and the toner image forming unit 512K, however, the belt position detection apparatus 600 may be provided in another position.

Figure 28:
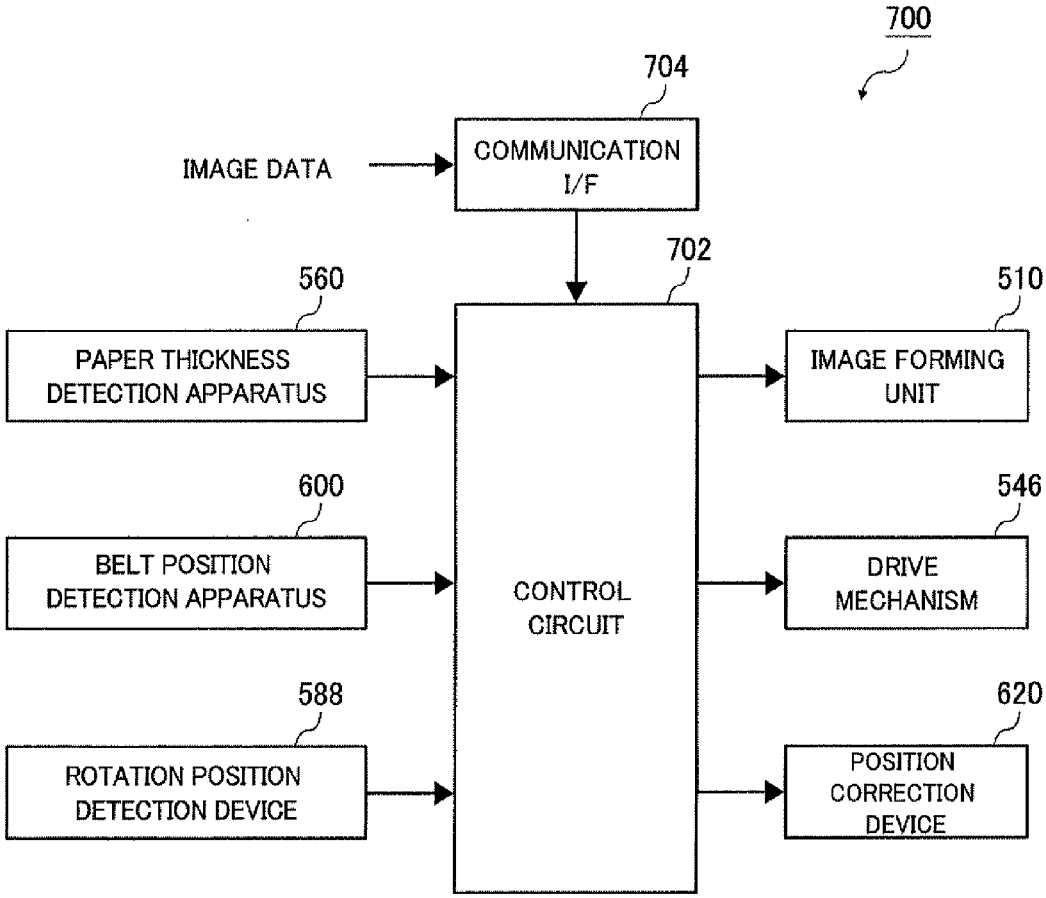
FIG. 28 is a block diagram showing a controller of the image forming apparatus according to the exemplary embodiment of the present invention.

FIG. 28 shows a controller 700 in the image forming apparatus 500 according to the present exemplary embodiment of the present invention.

The controller 700 has a control circuit 702 having e.g. a CPU, and image data is inputted into the control circuit 702 via a communication interface 704. Further, outputs from the paper thickness detection apparatus 560, the belt position detection apparatus 600, and the rotation position detection device 588 are inputted into the control circuit 702. Further, the image forming unit 510, the drive mechanism 546 and the position correction device 620 are controlled in accordance with outputs from the control circuit 702.

More particularly, the control circuit 702 compares the thickness of paper detected by the paper thickness detection apparatus 560 with previously-stored thickness of one sheet of paper, and determines whether or not paper multi-feed occurs in the position where the paper thickness detection apparatus 560 is provided. When it is determined that paper multi-feed does not occur, the control circuit 702 controls the drive mechanism 546, to continue paper feed by the feed roller 544 at predetermined timing. On the other hand, when it is determined that paper multi-feed occurs, the control circuit 702 stops the drive mechanism 546, to stop next paper feed by the feed roller 544.

Further, the control circuit 702 controls the position correction device 620 and changes the angle of the support roller 582 connected to the position correction device 620 to fix the position of the conveyance belt 580 in the direction substantially orthogonal to the conveyance direction based on the output from the belt position detection apparatus 600.

As described above, the present invention is applicable to a position detection apparatus, a paper thickness detection apparatus, and a belt position detection apparatus, and an image forming apparatus having at least one of the position detection apparatus, the paper thickness detection apparatus and the belt position detection apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A position detection apparatus comprising:

a moving member in contact with a detection object, the moving member moving with movement of the detection object, the moving member including a rotation shaft;

a detection unit that detects a positional change of the moving member;

a support member that rotatably supports the moving member, the support member including a through hole and the rotation shaft of the moving member is disposed within the through hole;

a diameter of the through hole is larger than a diameter of the rotation shaft;

a first pressing member and a second pressing member provided on opposite sides of the moving member, the first pressing member and the second pressing member attached to the moving member;

the first pressing member rotates the moving member against the detection object, presses against the moving member, and moves the rotation shaft in a direction of the detection object, and the second pressing member rotates the moving member against the detection object, and moves the rotation shaft in the direction of the detection object;

wherein at least one of the first pressing member and the second pressing member has:

a holding member that holds the moving member;

a contact member in contact with a contact surface formed approximately parallel to the direction of the rotation shaft of the moving member; and a connecting member that connects the holding member to the contact member, and an angle on a side of the moving member, formed with a plane including an end of the connecting member on a side of the holding member and an end of the connecting member on a side of the contact member, and the contact surface, is smaller than 90°.

2. The position detection apparatus according to claim 1, wherein the first pressing member has a torsion spring having a function of pressing the moving member in two linear directions which are approximately orthogonal, and causes a first force, a second force and a third force to act on the moving member, and the second pressing member causes the third force to act on the moving member.

3. The position detection apparatus according to claim 1, wherein the first pressing member has a torsion spring having a function of pressing the moving member in one linear direction, and causes a first force and a third force to act on the moving member, and the second pressing member has a spring having a function of pressing the moving member in two linear directions which are approximately orthogonal, and causes a second force and the third force to act on the moving member.

4. The position detection apparatus according to claim 1, wherein the first pressing member has a torsion spring having a function of pressing the moving member in two linear directions which are approximately orthogonal, and causes a first force, a second force and a third force to act on the moving member, and the second pressing member has a torsion spring having a function of pressing the moving member in one linear direction, and causes the first force and the third force to act on the moving member.

5. The position detection apparatus according to claim 1, wherein the moving member has:

a contact member in contact with the detection object; and wherein the rotation shaft has:

a large diameter member on a side of a main body; and a small diameter member positioned on a side of the support member from the large diameter member, with a diameter smaller than a diameter of the large diameter member, that has a step member between the smaller diameter member and the large diameter member, and the step member is chamfered.

6. The position detection apparatus according to claim 1, wherein the moving member has:

a main body in contact with the detection object; and wherein the shaft has:

a large diameter member on a side of the main body; and a small diameter member positioned on a side of the support member from the large diameter member, with a diameter smaller than a diameter of the large diameter member, that has a step member between the smaller diameter member and the large diameter member, and wherein the first pressing member or the second pressing member causes at least one of a first force, a second force and a third force to act on the moving member in a position on the side of the main body of the large diameter member.

7. The position detection apparatus according to claim 1, wherein a part or whole of the moving member is formed of an elastic body, and tile moving member generates at least one of a first force, a second force and a third force by elasticity.

8. The position detection apparatus according to claim 1, wherein a part or whole of the support member is formed of an elastic body, and the support member generates at least one of a first force, a second force and a third force by elasticity.

9. The position detection apparatus according to claim 1, wherein a part or whole of the moving member is formed of an elastic body, and the moving member generates at least one of a first force, a second force and a third force by elasticity, and a part or whole of the support member is formed of an elastic body, and the support member generates at least another of the first force, the second force and the third force by elasticity.

10. A paper thickness detection apparatus comprising:

a conveyance roller used for conveyance of paper;

a driven roller pressed against the conveyance roller that moves, upon passage of the paper between the driven roller and the conveyance roller, in a direction away from the conveyance roller in correspondence with a thickness of the paper; and a position detection apparatus that detects a position of the driven roller, the position detection apparatus having:

a moving member in contact with the driven roller that moves following movement of the driven roller, the moving member including a rotation shaft;

a detection unit that detects a positional change of the moving member;

a support member that rotatably supports the moving member, the support member including a through hole and the rotation shaft of the moving member is disposed within the through hole;

a diameter of the through hole is larger than a diameter of the rotation shaft;

a first pressing member and a second pressing member provided on opposite sides of the moving member, the first pressing member and the second pressing member attached to the moving member;

the first pressing member rotates the moving member against the driven roller, presses the moving member to the support member, and moves the rotation shaft in a direction of the driven roller, and the second pressing member rotates the moving member against the driven roller, and moves the rotation shaft in the direction of the driven roller;

wherein at least one of the first pressing member and the second pressing member has:

a holding member that holds the moving member;

a contact member in contact with a contact surface formed approximately parallel to the direction of the rotation shaft of the moving member; and a connecting member that connects the holding member to the contact member, and an angle on a side of the moving member, formed with a plane including an end of the connecting member on a side of the holding member and an end of the connecting member on a side of the contact member, and the contact surface, is smaller than 90°.

11. A belt position detection apparatus comprising:

a moving member in contact with a belt that moves following movement of the belt in a widthwise direction, the moving member including a rotation shaft;

a detection unit that detects a positional change of the moving member;

a support member that rotatably supports the moving member, the support member including a through hole and the rotation shaft of the moving member is disposed within the through hole;

a diameter of the through hole is larger than a diameter of the rotation shaft;

a first pressing member and a second pressing member provided on opposite sides of the moving member, the first pressing member and the second pressing member attached to the moving member; and the first pressing member rotates the moving member against the belt, presses the moving member to the support member, and moves the rotation shaft in a direction of the belt, and the second pressing member rotates the moving member against the belt, and moves the rotation shaft in the direction of the belt;

wherein at least one of the first pressing member and the second pressing member has:

a holding member that holds the moving member;

a contact member in contact with a contact surface formed approximately parallel to the direction of the rotation shaft of the moving member; and a connecting member that connects the holding member to the contact member, and an angle on a side of the moving member, formed with a plane including an end of the connecting member on a side of the holding member and an end of the connecting member on a side of the contact member, and the contact surface, is smaller than 90°.

12. An image forming apparatus comprising:

an image forming unit that forms an image;

a supply device that supplies paper to the image forming unit; and a paper thickness detection apparatus that detects a thickness of the paper supplied from the supply device, the paper thickness detection apparatus having:

a conveyance roller used for conveyance of paper;

a driven roller pressed against the conveyance roller that moves, upon passage of the paper between the driven roller and the conveyance roller, in a direction away from the conveyance roller in correspondence with the thickness of the paper; and a position detection apparatus that detects a position of the driven roller, the position detection apparatus having:

a moving member in contact with the driven roller that moves following movement of the driven roller, the moving member including a rotation shaft;

a detection unit that detects a positional change of the moving member;

a support member that rotatably supports the moving member, the support member including a through hole and the rotation shaft of the moving member is disposed within the through hole;

a diameter of the through hole is larger than a diameter of the rotation shaft;

a first pressing member and a second pressing member provided on opposite sides of the moving member, the first pressing member and the second pressing member attached to the moving member; and the first pressing member rotates the moving member against the driven roller, presses the moving member to the support member, and moves the rotation shaft in a direction of the driven roller, and the second pressing member rotates the moving member against the driven roller, and moves the rotation shaft in the direction of the driven roller;

wherein at least one of the first pressing member and the second pressing member has:

a holding member that holds the moving member;

a contact member in contact with a contact surface formed approximately parallel to the direction of the rotation shaft of the moving member; and a connecting member that connects the holding member to the contact member, and an angle on a side of the moving member, formed with a plane including an end of the connecting member on a side of the holding member and an end of the connecting member on a side of the contact member, and the contact surface, is smaller than 90°.

13. An image forming apparatus comprising:

a conveyance member that conveys at least one of a toner image and paper on which the toner image is transferred;

an image forming unit that forms the toner image transferred onto at least one of the conveyance member and the paper conveyed by the conveyance member; and a position detection apparatus that detects a positional change of the conveyance member, the position detection apparatus having:

a moving member in contact with the conveyance member that moves the moving member moving with movement of the conveyance member in a widthwise direction, the moving member including a rotation shaft;

a detection unit that detects a positional change of the moving member;

a support member that rotatably supports the moving member, the support member including a through hole and the rotation shaft of the moving member is disposed within the through hole;

a diameter of the through hole is larger than a diameter of the rotation shaft;

a first pressing member and a second pressing member provided on opposite sides of the moving member, the first pressing member and the second pressing member attached to the moving member; and the first pressing member rotates the moving member against the conveyance member, presses the moving member to the support member, and moves the rotation shaft in a direction of the conveyance member, and the second pressing member rotates the moving member against the conveyance member, and moves the rotation shaft in the direction of the conveyance member.

14. The position detection apparatus according to claim 1, wherein the second pressing member is attached to the moving member, and the second pressing member is configured to be elastically deformed such that the moving member is pressed in the direction of the detection object.

* * * * *